US011992785B1

(12) United States Patent
Bernklau

(10) Patent No.: US 11,992,785 B1
(45) Date of Patent: May 28, 2024

(54) BUILDING SYSTEM

(71) Applicant: Nathaniel Ross Bernklau, Keller, TX (US)

(72) Inventor: Nathaniel Ross Bernklau, Keller, TX (US)

( * ) Notice: Subject to any disclaimer, the term of this patent is extended or adjusted under 35 U.S.C. 154(b) by 52 days.

(21) Appl. No.: 17/232,475

(22) Filed: Apr. 16, 2021

Related U.S. Application Data

(60) Provisional application No. 63/010,777, filed on Apr. 16, 2020.

(51) Int. Cl.
*A63H 33/10* (2006.01)

(52) U.S. Cl.
CPC ..... *A63H 33/108* (2013.01); *A63H 33/105* (2013.01)

(58) Field of Classification Search
CPC .... A63H 33/10; A63H 33/102; A63H 33/105; A63H 33/108; A63H 33/12; A63H 3/04; A63H 33/084; A63H 33/088
USPC ..... 446/124, 126
See application file for complete search history.

(56) References Cited

U.S. PATENT DOCUMENTS 1,707,691 A * 4/1929 Sweet ..... A63H 33/06 446/124
2,868,568 A * 1/1959 Frye ..... A63H 33/06 403/171
3,284,926 A * 11/1966 Godfrey ..... G09B 23/26 446/121
3,830,011 A * 8/1974 Ochrymowich ..... A63H 33/102 446/107
4,078,328 A * 3/1978 Rayment ..... A63H 33/108 446/102
4,551,960 A * 11/1985 Fleishman ..... E04B 1/1903 403/172
D281,794 S * 12/1985 Short ..... D21/489
4,787,191 A * 11/1988 Shima ..... A63H 33/088 403/171
5,049,105 A * 9/1991 Glickman ..... A63H 33/10 446/107
5,097,645 A * 3/1992 Sanderson ..... E04B 1/1903 403/171
5,137,486 A * 8/1992 Glickman ..... A63H 33/101 446/124
5,318,470 A * 6/1994 Denny ..... A63H 33/10 52/655.2
5,908,342 A * 6/1999 Wolvin ..... A63F 9/12 446/124
6,176,757 B1 * 1/2001 Lin ..... A63H 33/101 446/104
2003/0007829 A1 * 1/2003 Huang ..... A63H 33/101 403/171
2003/0176142 A1 * 9/2003 Mimlitch, III ..... A63H 33/107 446/85

* cited by examiner

*Primary Examiner* — William V Gilbert
(74) *Attorney, Agent, or Firm* — Jeffrey Roddy

(57) ABSTRACT

A construction set includes one or more hubs and a plurality of tubular struts. Some of the hubs include a central aperture to receive a length of a tubular strut. Some of the hubs include one or more strut coupler prongs arranged radially about the central aperture. Some of the hubs include a central slot adapted to receive a portion of another hub such that the connected hubs are secured at right angles relative to one another.

2 Claims, 29 Drawing Sheets

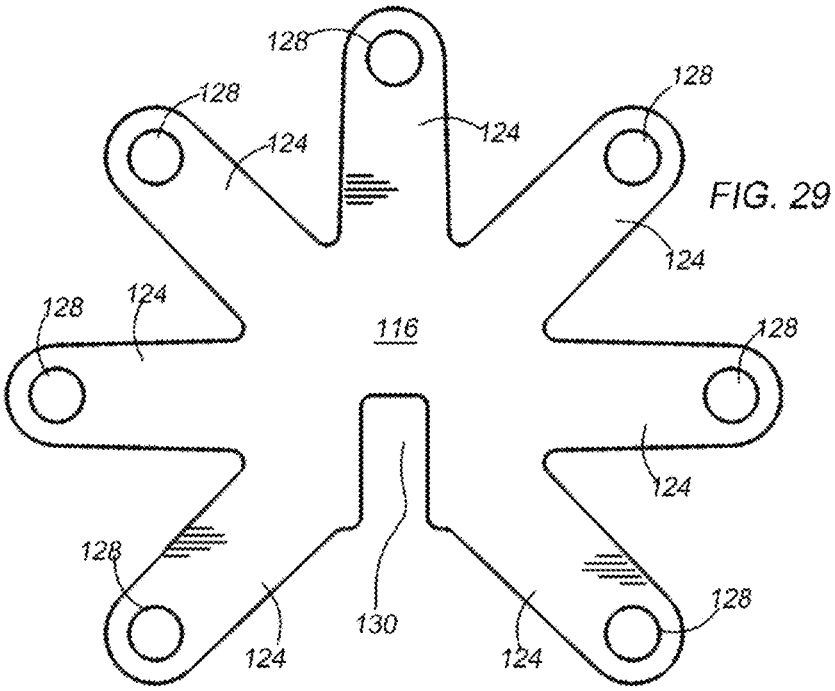
FIG. 29
FIG. 30
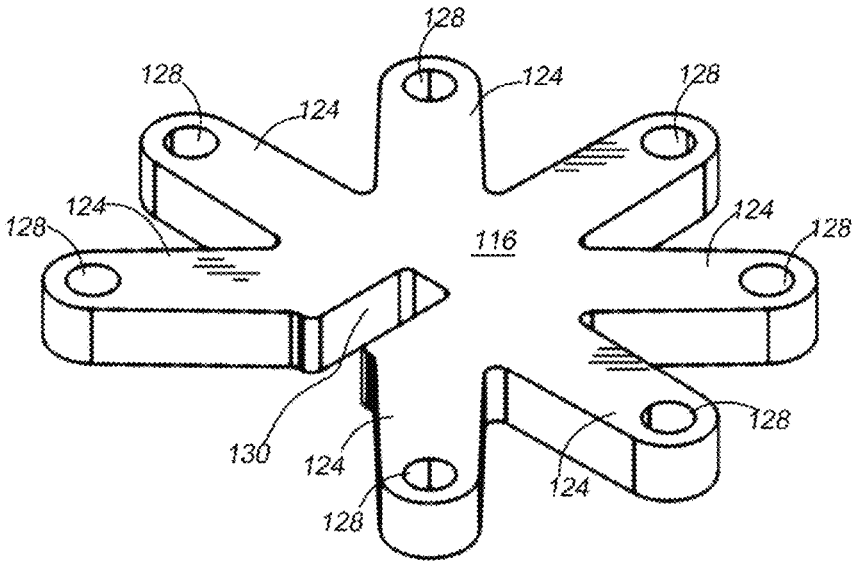

FIG. 40A
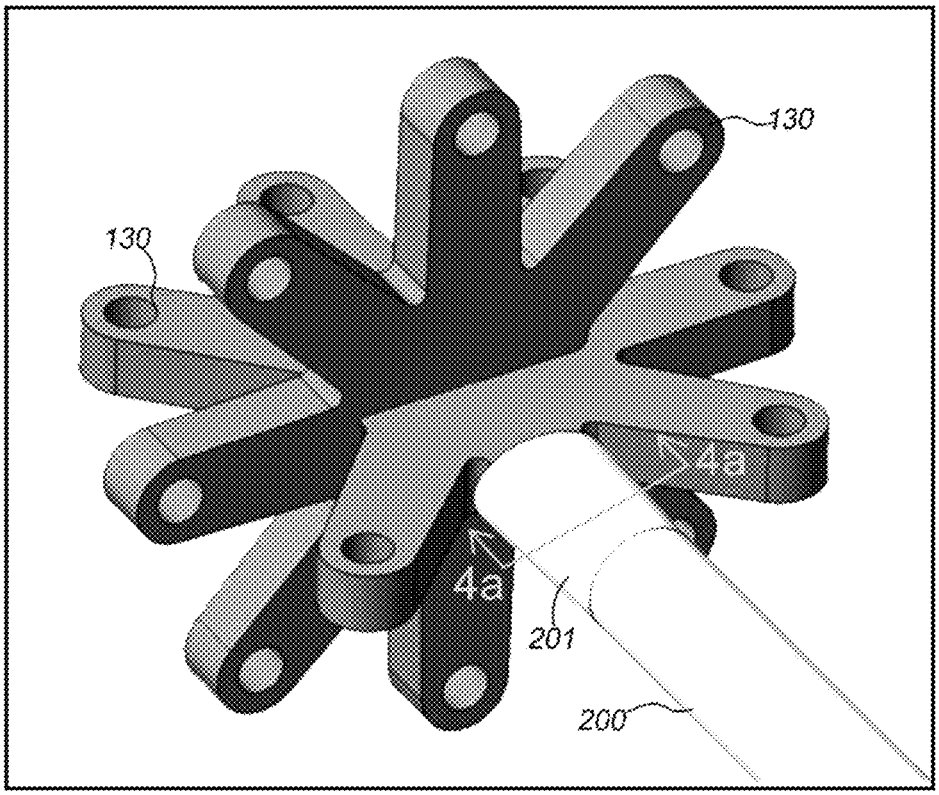
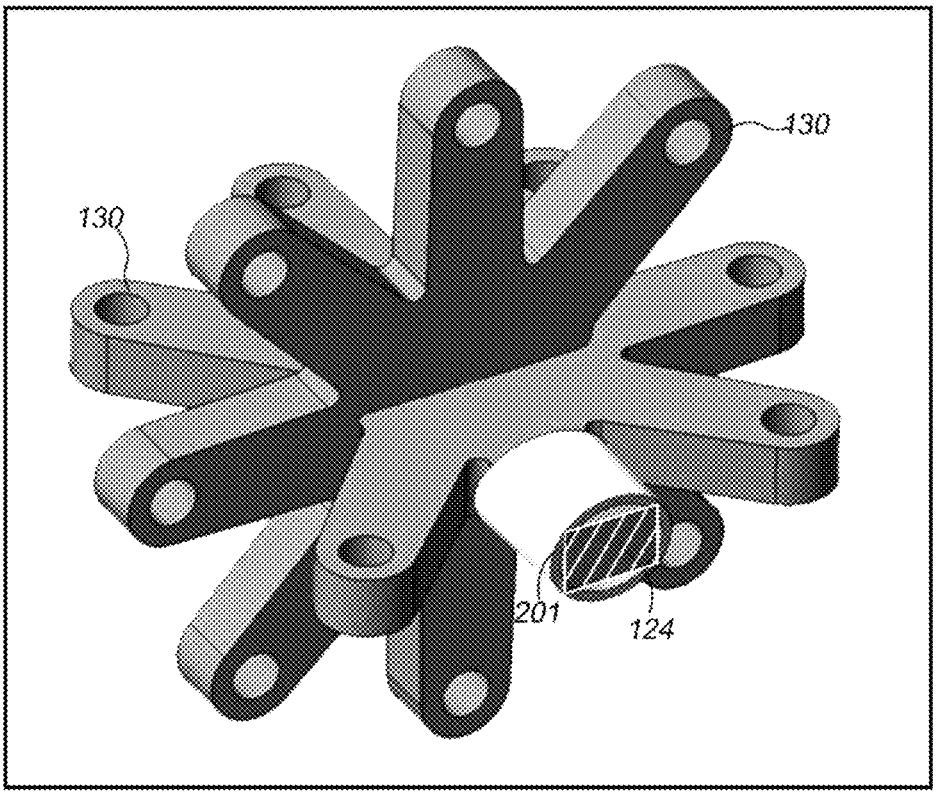
FIG. 40B 506
511
511
504
508
512
501
502
510
509
516
505
514

BUILDING SYSTEM

TECHNICAL FIELD

The invention relates generally to building systems and more particularly structural modeling systems, including toy construction sets.

BACKGROUND

Construction sets are long known in the art and may typically include various hubs that are adapted to connect with struts. One well known example is the TinkerToy® construction set that includes cylindrical hubs and slotted struts configured for insertion radially into circumferential apertures about the hub. While the TinkerToy® set works well for younger children, it is somewhat limited with regard to types of structures obtainable. In some constructions for example, it may be desirable to limit or inhibit rotatory motion of the struts, while in other constructions it may be desirable to include one or more lengths of cord as a structural component.

It would be desirable to provide a construction set that includes a variety of hubs, some including radial prongs set at various angles for greater versatility.

It would be further desirable if some of the hubs were configured to interlock at a right angle.

It would be further desirable if the radial prongs were adapted to couple with a tubular strut and restrict axial rotation of the strut.

It would be even further desirable if a coupled arrangement between a strut and hub were adapted to secure a length of cord.

SUMMARY

In a general example implementation of the present invention, a construction set includes one or more hubs and a plurality of tubular struts. Some of the hubs include a central aperture to receive a length of a tubular strut. Some of the hubs include one or more strut coupler prongs arranged radially about the central aperture. Some of the hubs include a central slot adapted to receive a portion of another hub such that the connected hubs are secured at right angles relative to one another.

In an aspect combinable with the general implementation, the one or more hubs include a generally planar front face, back face, and sides.

In an aspect combinable with the general implementation, the one or more strut coupler prongs taper along the sides from a proximal portion to a distal portion.

In an aspect combinable with any other aspect, the strut coupler prongs include a distal securing element adapted to secure a length of cord.

In an aspect combinable with any other aspect, the prongs may include an aperture or a slot at the distal ends.

In an aspect combinable with any other aspect, some prongs of a hub may radiate from the hub at 180° relative to one another.

In an aspect combinable with any other aspect, some prongs of a hub may radiate from the hub at 120° relative to one another.

In an aspect combinable with any other aspect, some prongs of a hub may radiate from the hub at 90° relative to one another.

In an aspect combinable with any other aspect, some prongs of a hub may radiate from the hub at 120° relative to one another.

In an aspect combinable with any other aspect, some prongs of a hub may radiate from the hub at 60° relative to one another.

In an aspect combinable with any other aspect, some prongs of a hub may radiate from the hub at 21° relative to one another.

In various aspects, combinable with any other aspect, some of the hubs include 1 prong, 2 prongs, 3 prongs, 4 prongs, 5 prongs, 6 prongs, 7 prongs or 8 prongs.

In various aspects, combinable with any other aspect, some of the hubs include three block attachment prongs.

In various aspects combinable with any other aspect, the tubular struts may be a paper construction.

In various implementations, the building system may include a tube cutter with features that permit the safe sizing and cutting of tubular struts to desired lengths.

Other advantages of the present invention will become apparent from the following descriptions, taken in connection with the accompanying drawings wherein by way of illustration and example, preferred embodiments of the present invention are disclosed.

BRIEF DESCRIPTION OF THE DRAWING FIGURES

FIGS. 1-13 include plan views of exemplary various hub members, an exemplary strut (FIG. 12), and a quantity of cord or twine (FIG. 13);

FIGS. 29 and 30 depict respectively, a plan view and an isometric view of an exemplary hub member;

FIG. 40A is an enlarged view showing a connection between a strut and a strut coupler prong;

FIG. 40B is an enlarged view of the cross-section taken through lines (4*a*-4*a*) of (FIG. 40A);

Figure 1:
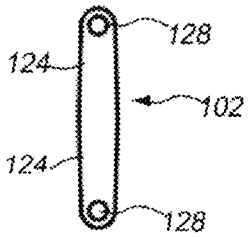
Figure 2:
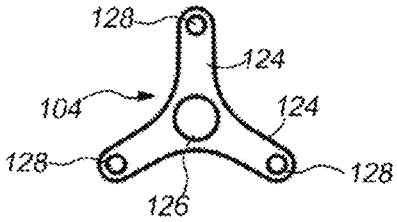
Figure 3:
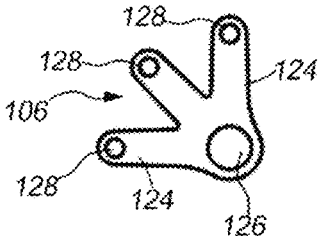
Figure 4:
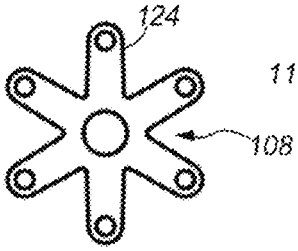
Figure 5:
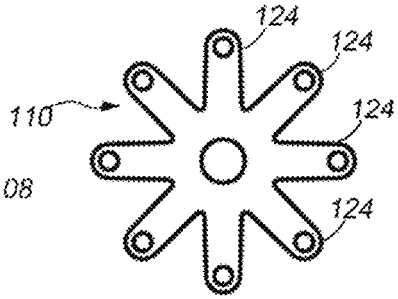
Figure 6:
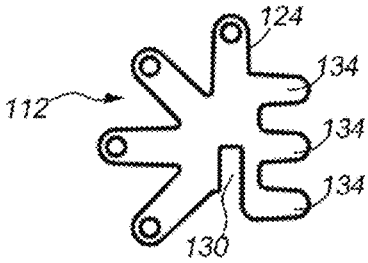
Figure 7:
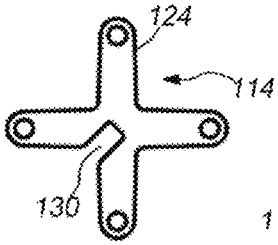
Figure 8:
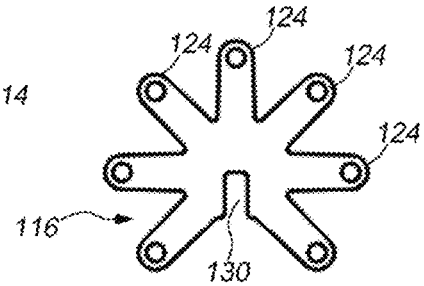
Figure 9:
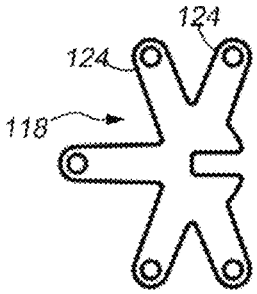
Figure 10:
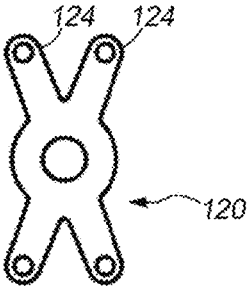
Figure 11:
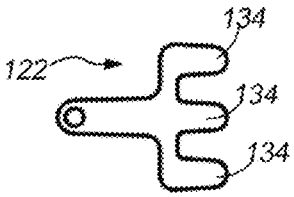
Figure 13:
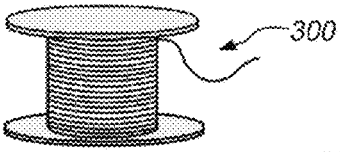
Figure 12:
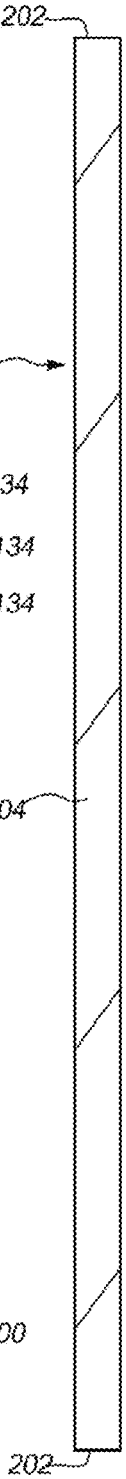
Figure 14:
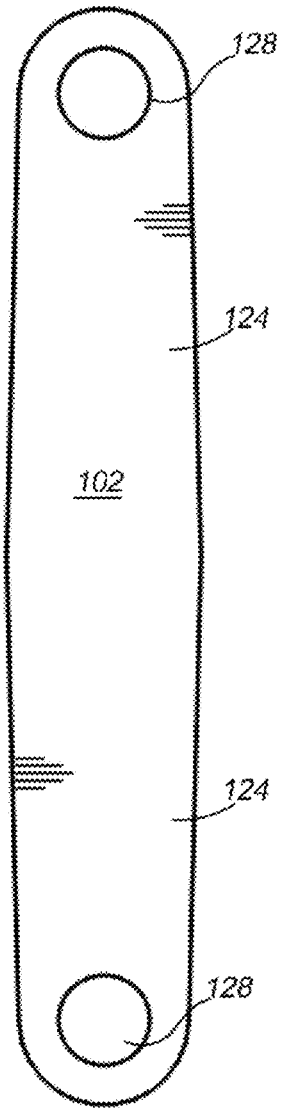
FIGS. 14-16 depict respectively, a plan view, side view and isometric view of an exemplary hub member.
Figure 15:
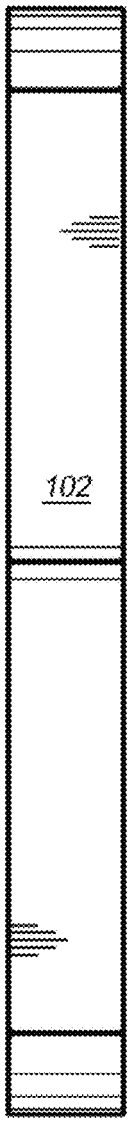
Figure 16:
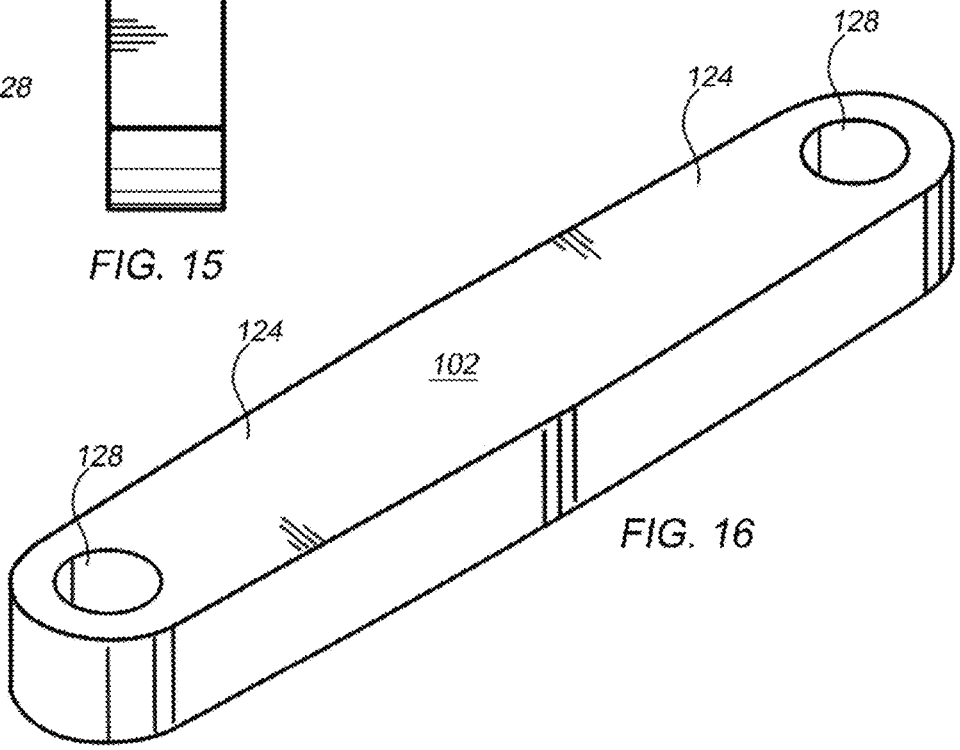
Figure 17:
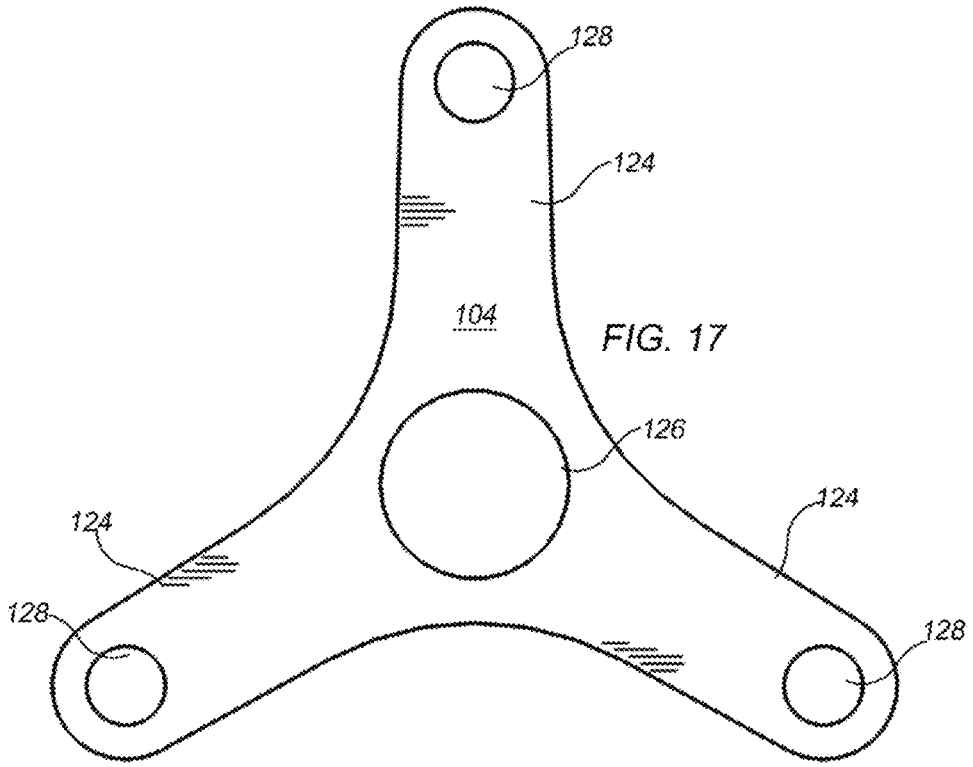
FIGS. 17 and 18 depict respectively, a plan view and an isometric view of an exemplary hub member.
Figure 18:
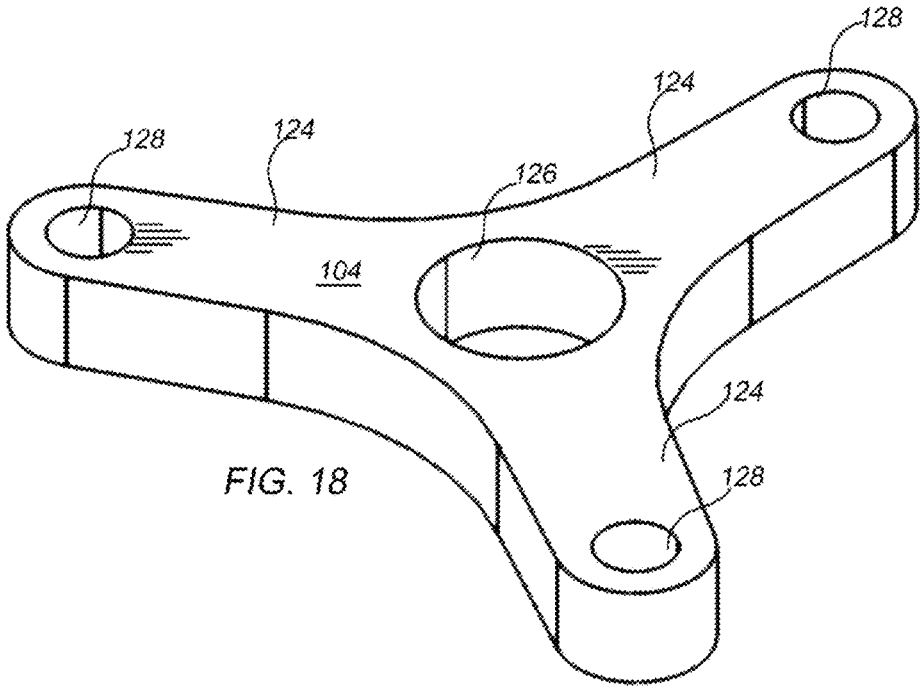
Figure 19:
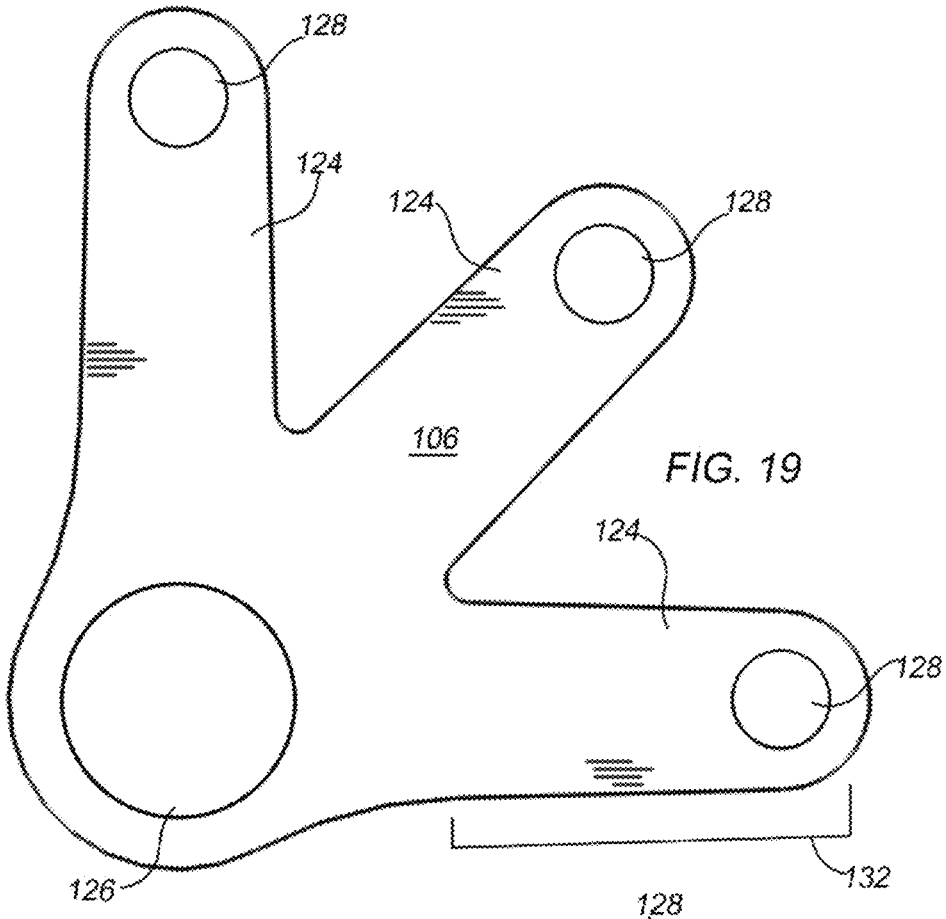
FIGS. 19 and 20 depict respectively, a plan view and an isometric view of an exemplary hub member.
Figure 20:
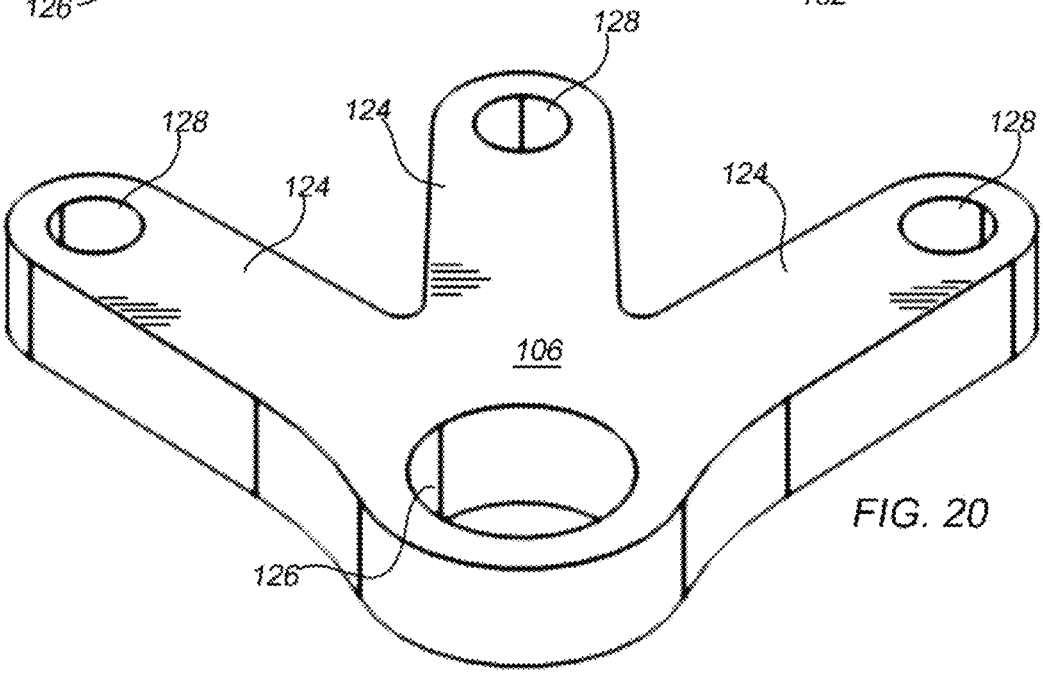
Figure 21:
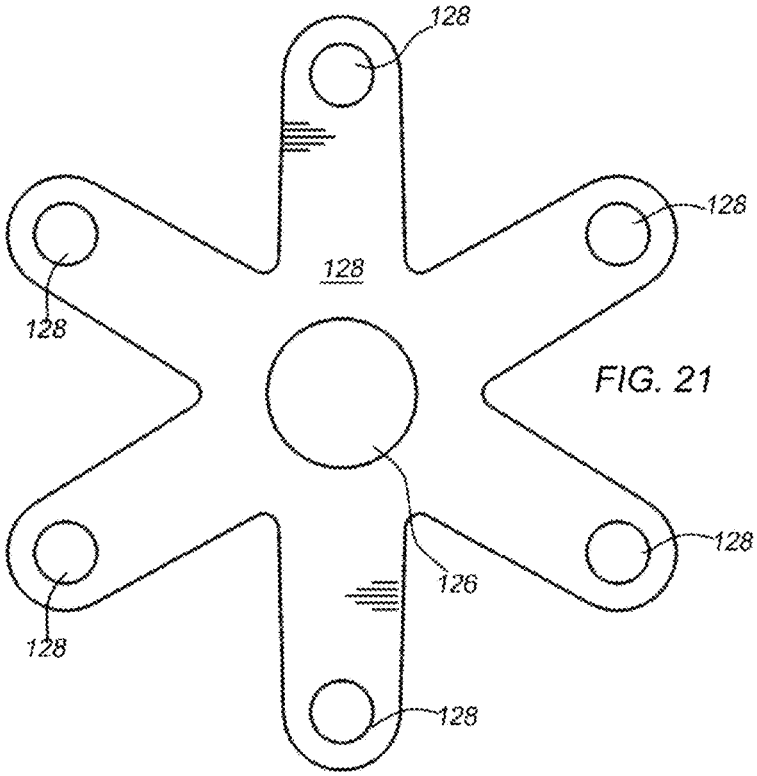
FIGS. 21 and 22 depict respectively, a plan view and an isometric view of an exemplary hub member.
Figure 22:
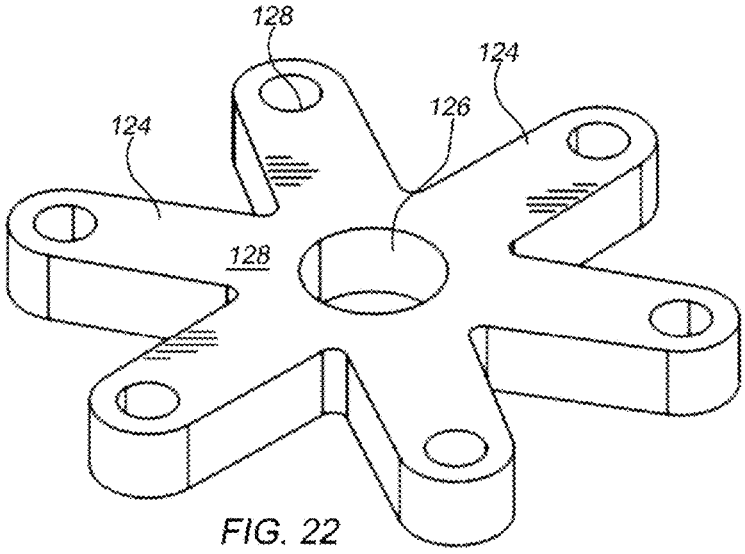
Figure 23:
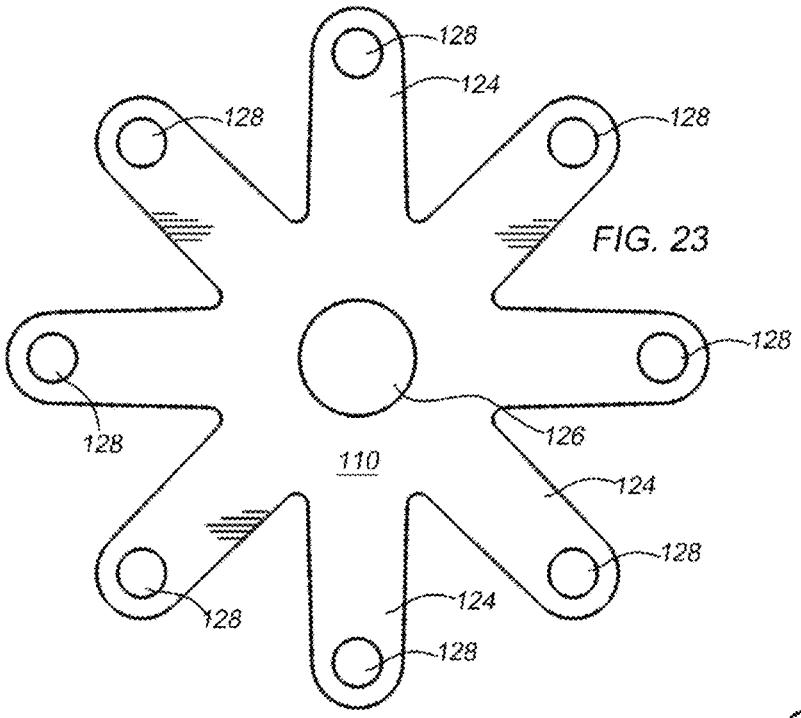
FIGS. 23 and 24 depict respectively, a plan view and an isometric view of an exemplary hub member.
Figure 24:
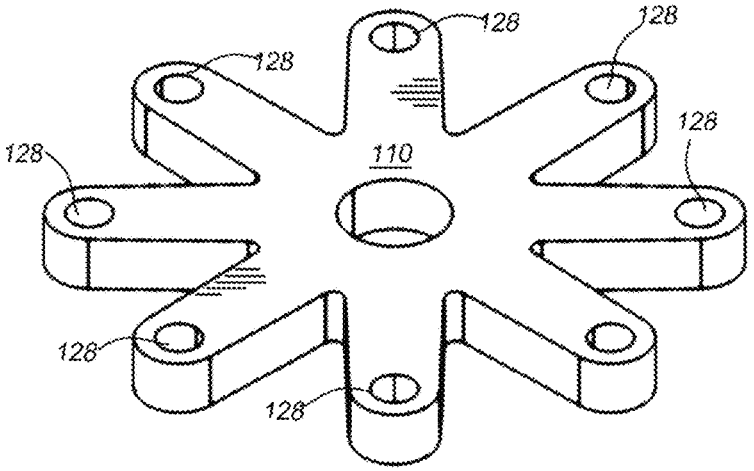
Figure 25:
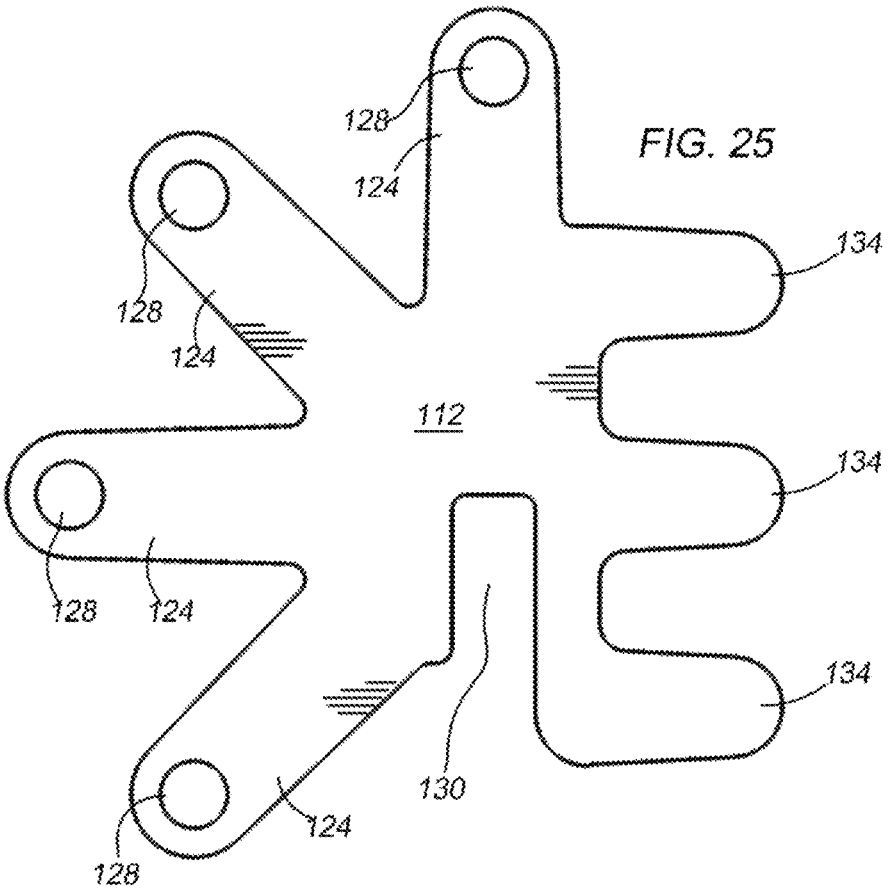
FIGS. 25 and 26 depict respectively, a plan view and an isometric view of an exemplary hub member.
Figure 26:
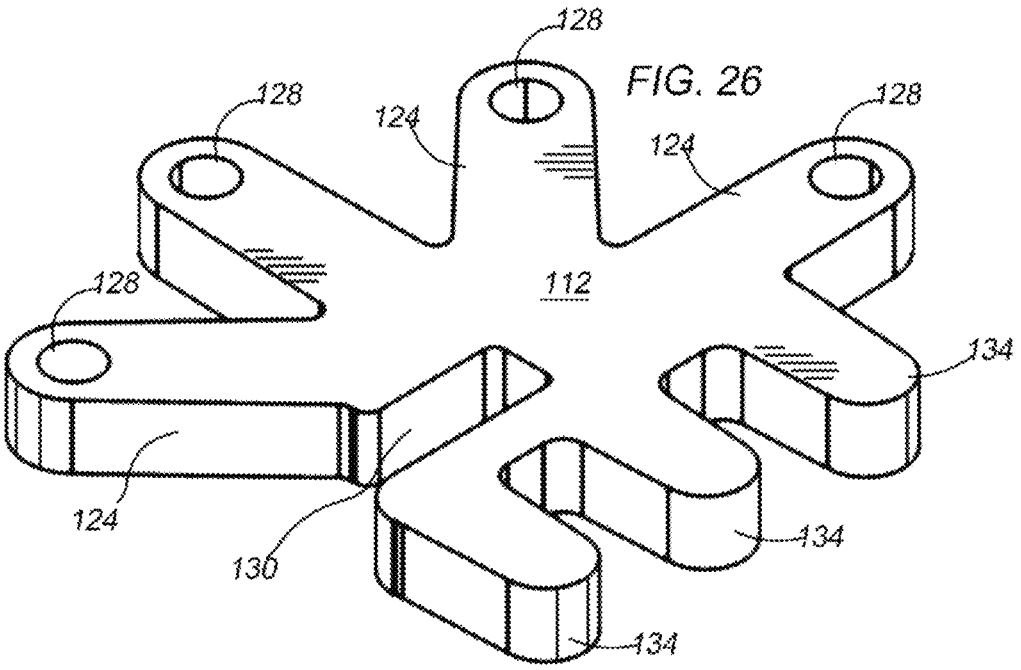
Figure 27:
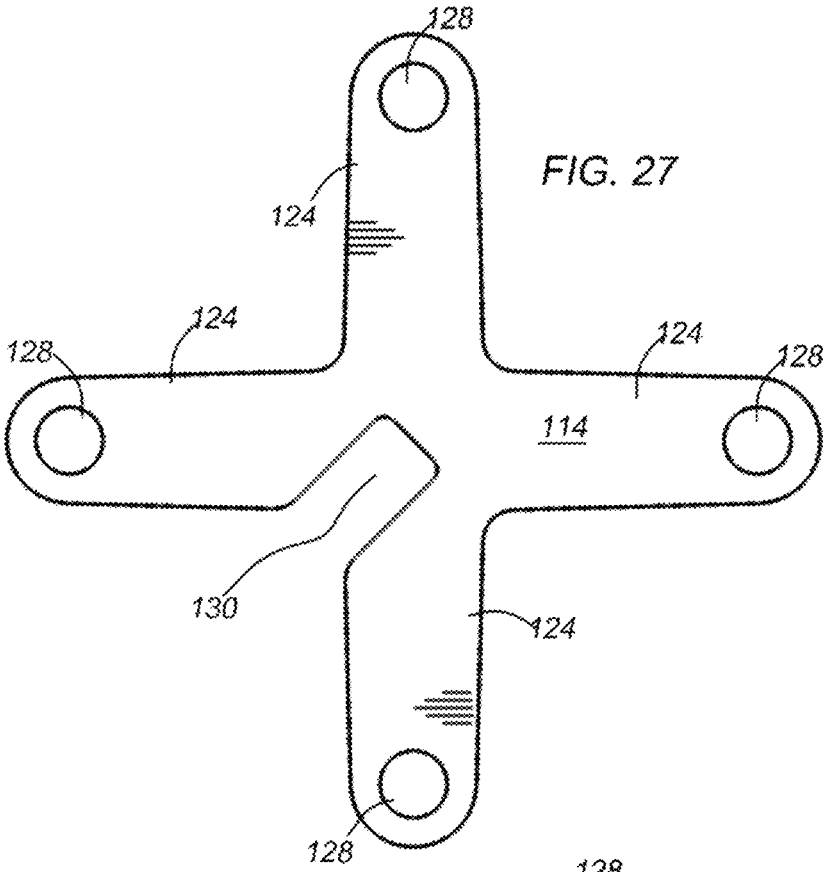
FIGS. 27 and 28 depict respectively, a plan view and an isometric view of an exemplary hub member.
Figure 28:
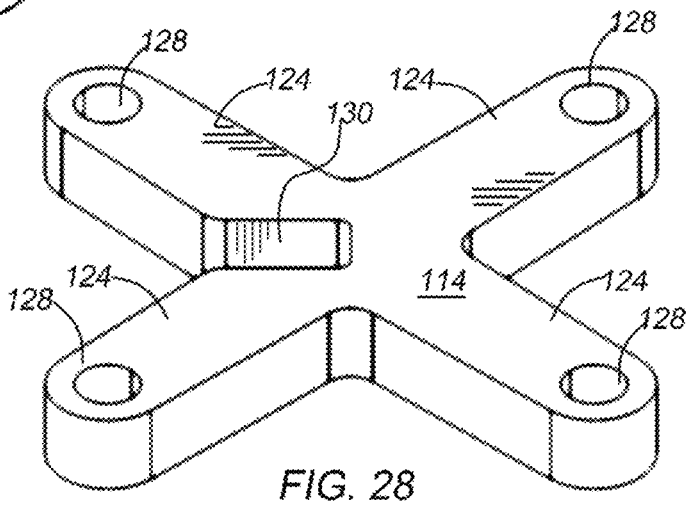
Figure 31:
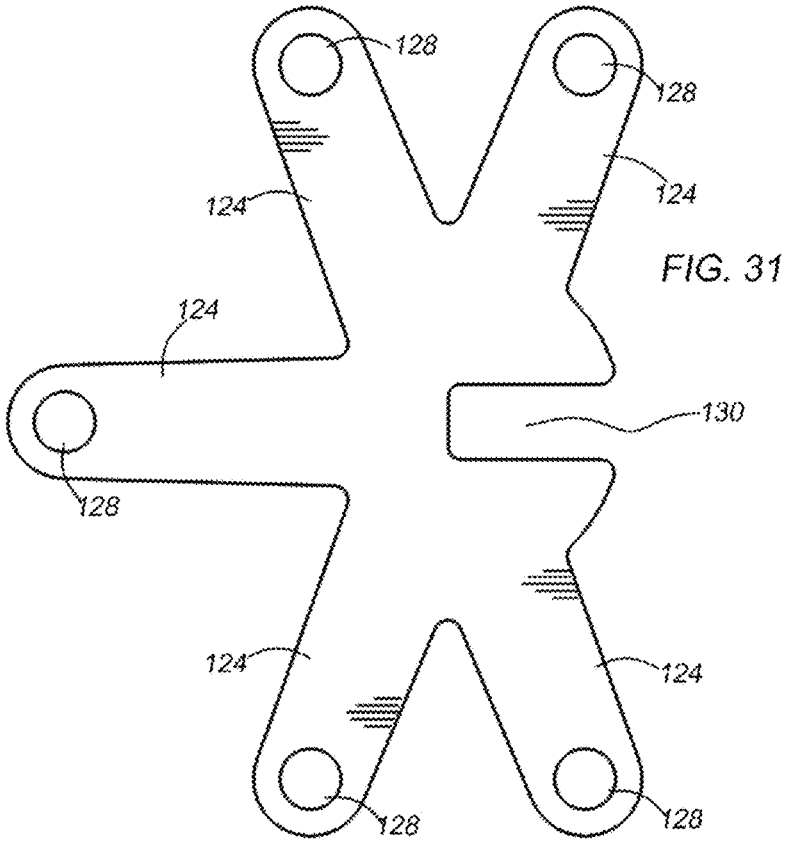
FIGS. 31 and 32 depict respectively, a plan view and an isometric view of an exemplary hub member.
Figure 32:
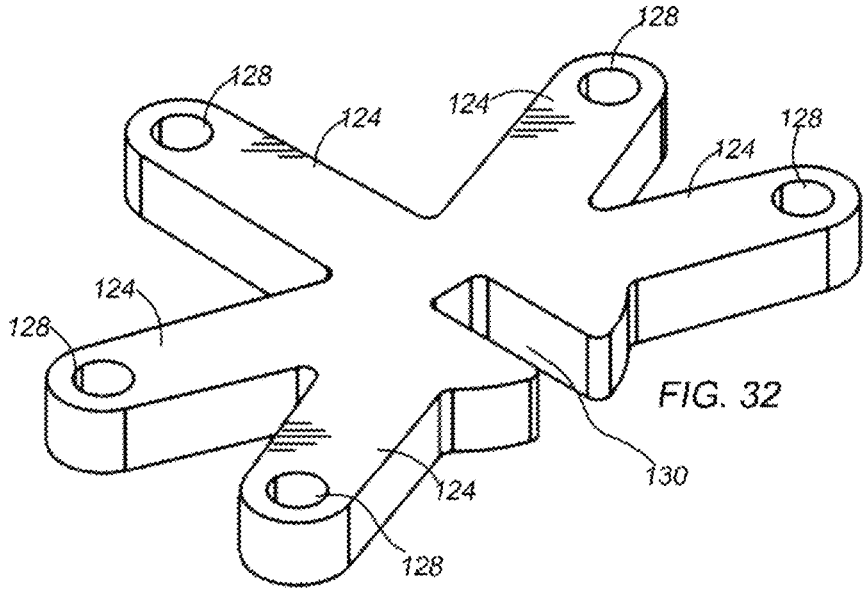
Figure 33:
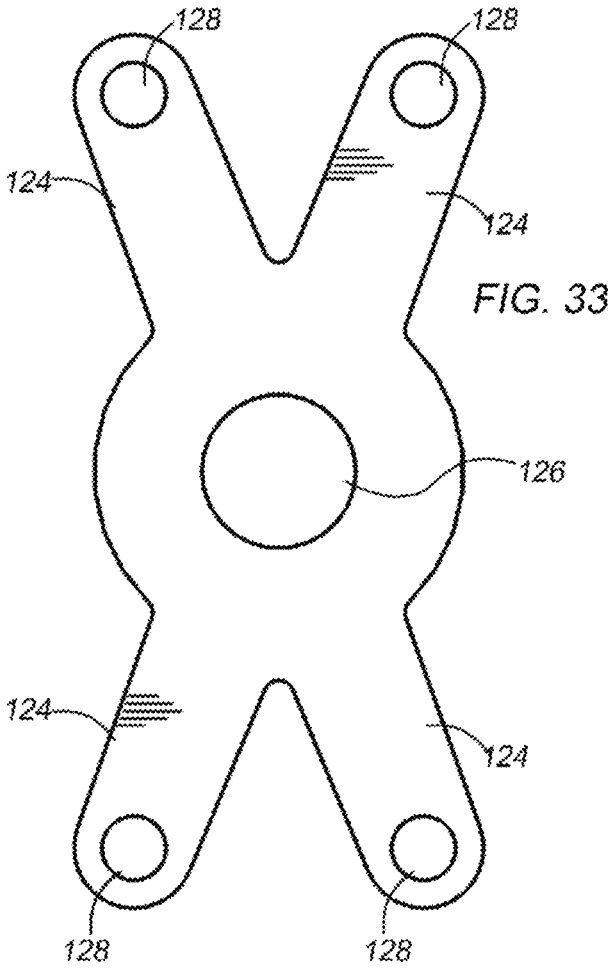
FIGS. 33 and 34 depict respectively, a plan view and an isometric view of an exemplary hub member.
Figure 34:
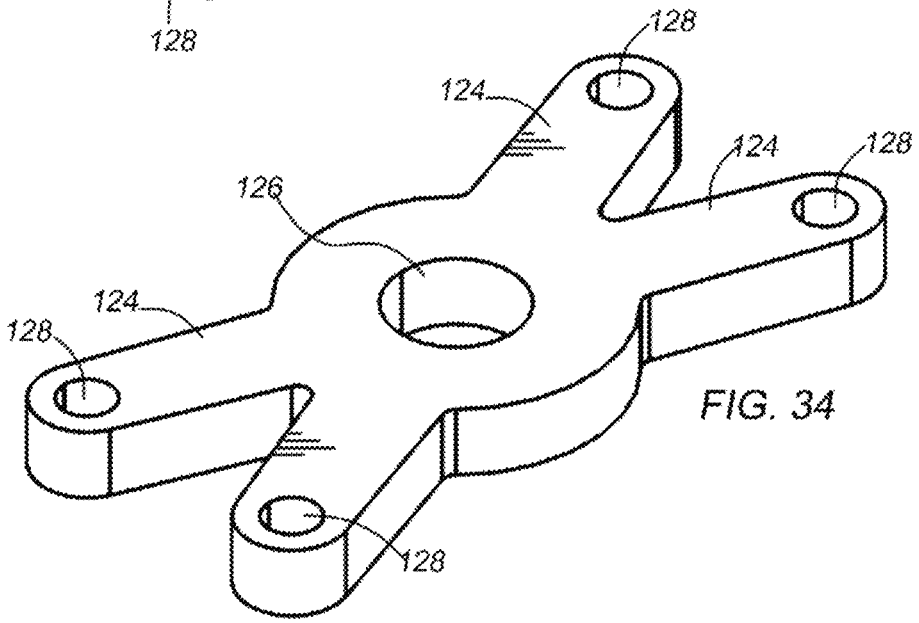
Figure 35:
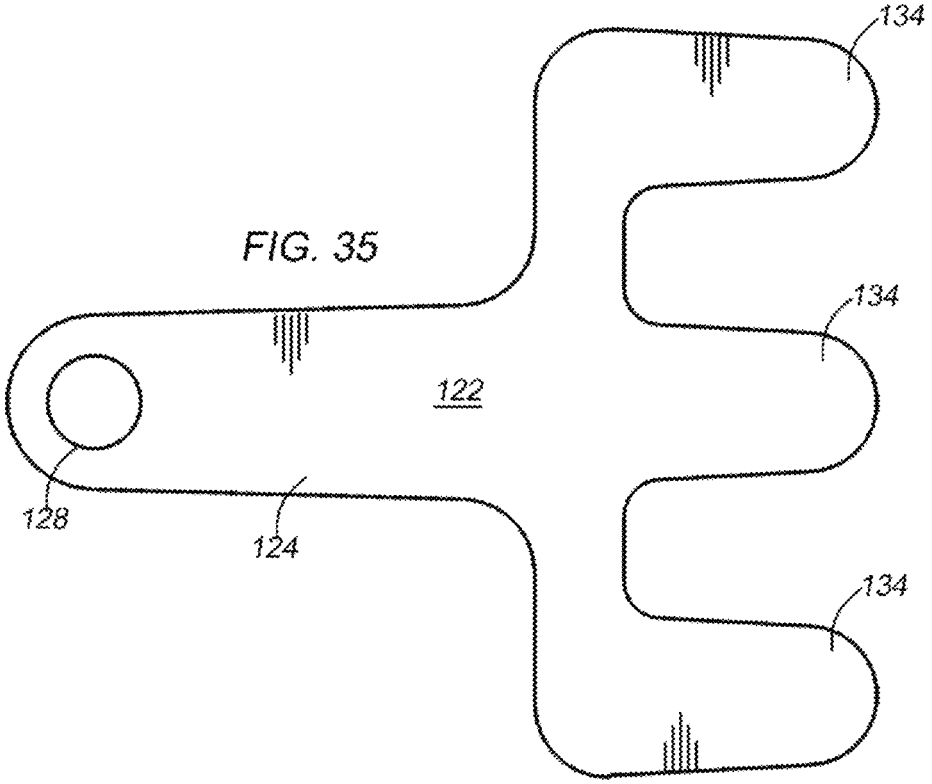
FIGS. 35 and 36 depict respectively, a plan view and an isometric view of an exemplary hub member.
Figure 36:
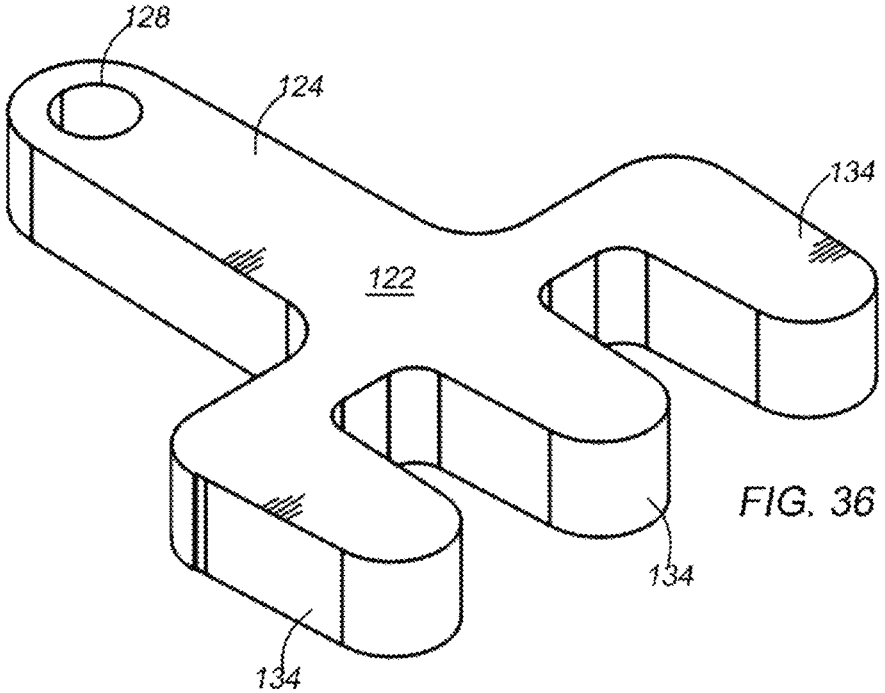

REFERENCE TO THE NUMBERED ELEMENTS hub member (**2*p*180) 102**
hub member (**3*p*120) 104**
hub member (**3*p*45) 106**
hub member (**6*p*60) 108**
hub member (**8*p*45) 110**
hub member (**4*p*13) 112**
hub member (**4*p*90) 114**
hub member (**7*p*45) 116**
hub member (**5*p*21) 118**
hub member (**4*p*21) 120**
hub member (**1*p*31) 122**
prong 124
prong angle 125
axial aperture 126
radial aperture 128
slot 130
taper 132
block interlock 134
strut 200
strut end 201
strut body 204
strut mouth 206
cable 300
block 400
block aperture(s) 402
tube cutter assembly 500
tube cutter base 501
blade cradle 502
blade 504
outer tube pass-through slot 505
movable member 506
inner tube pass-through apertures 508
pivot post 509
post insertion apertures 510
blade channel 511
spring 512
tube length gauge 514
tube guide 516
spring recess 518

Definitions

In the following description, unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Figure 55:
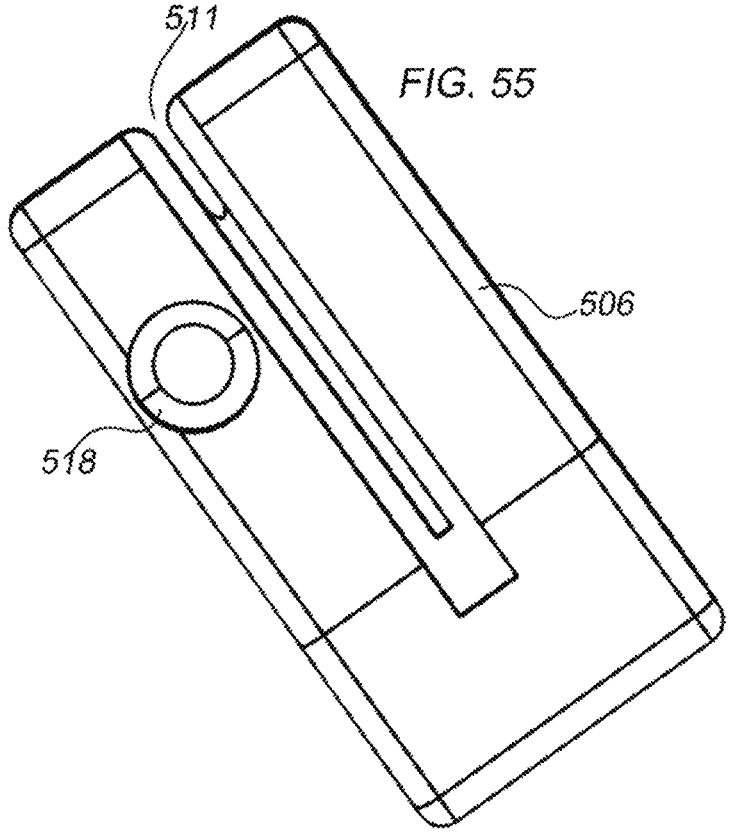
FIG. 55 is a bottom view thereof.

Referring generally to FIGS. 1-55, exemplary implementations according to the present invention are shown and include a construction set (100) including hubs (102, 104, 106, 108, 110, 112, 114, 116, 118, 120 and 122) with each hub including one or more strut coupler prongs (124). Set (100) includes a plurality of tubular struts (200) (e.g., paper straws or paper board tubes) adapted for mounting onto the strut coupler prongs. Strut coupler prongs (124) are typically arranged radially about a central portion of each hub and include an aperture (128) at a distal end of each prong. Some hubs include a central aperture (126) shaped and sized for the insertion of a strut therethrough. Some hubs include a central slot (130) shaped and sized to couple with another hub slot or other portion of a hub. In some implementations, it is possible that instead of a distal aperture, some of the prongs include a narrow distal slot (not shown) adapted to receive a length of cord or twine and retain the length of cord or twine with a compression or friction fit. In some implementations, the diameter of a tubular strut (200) is slightly less than the width of a proximal portion of a strut coupler prong (124). Hubs and struts may be assembled into a matrix forming structures of various sizes and shapes. Cord (300) secured between a strut mouth (202) and a strut coupler prong (124) when the two are coupled may serve various structural purposes (e.g., a tensioning element to add rigidity to a structure; tensegrity). Some hubs include a group of block attachment prongs (134) in a comb-like arrangement adapted to couple with a LEGO® style building block. In any of the implementations herein, the system may be paired with a tube cutter (500) (FIGS. 49-55) with features permitting the safe cutting of tubes or straws.

Moving to FIGS. 1-11, exemplary hubs may include but are not limited to the following prong configurations: hub (102) includes two strut coupler prongs set at 180° relative to one another; hub (104) includes three strut coupler prongs radially equidistant about a central aperture (126); hub (106) includes three strut coupler prongs radiating at 45° relative to one another with a central aperture (126) on the proximal side of the prongs; hub (108) includes six strut coupler prongs radiating at 60° relative to one another; hub (110) includes eight strut coupler prongs radiating at 45° relative to one another; hub (112) includes four strut coupler prongs on one side of the hub radiating at 45° relative to one another, a group of three block attachment prongs on the other side of the hub and a central slot; hub (114) includes four strut coupler prongs at 90° relative to one another; hub (116) includes seven strut coupler prongs at 45° relative to one another and a central slot (130); hub (118) includes two pairs of strut coupler prongs wherein the prongs of each pair are at 21° relative to one another, a fifth strut coupler prong projecting equidistantly between the two pairs of prongs and a central slot; hub (120) includes two pairs of strut coupler prongs disposed 21° relative to one another and a central aperture; and, hub (121) is trident shaped with a group of three block attachment prongs on one side of the hub and a single strut coupler prong opposite the group of three block attachment prongs.

FIGS. 1-11 as previously described and 14-36 in enlarged views, depict various exemplary hubs with different prong configurations. Prongs (124) are tapering along their sides allowing for non-destructive insertion into a strut mouth (202) and include a distally disposed aperture (128) adapted to receive a length of cord which may be passed cleanly through the distally disposed aperture and may be tied off and/or looped around other portions of the hub. In the implementation depicted, the hubs may be laser cut from a sheet of 0.125 inch MDF. Other exemplary hubs may be laser cut or machined by any means that might be appreciated by those with skill in the art from any suitable sheet material of a uniform thickness suitable for non-destructive insertion into a strut or the hubs may be molded plastic. Hubs that are molded plastic may be non-planar on their top or bottom sides and include compound angles enabling the construction of domes and spheres.

Figure 37:
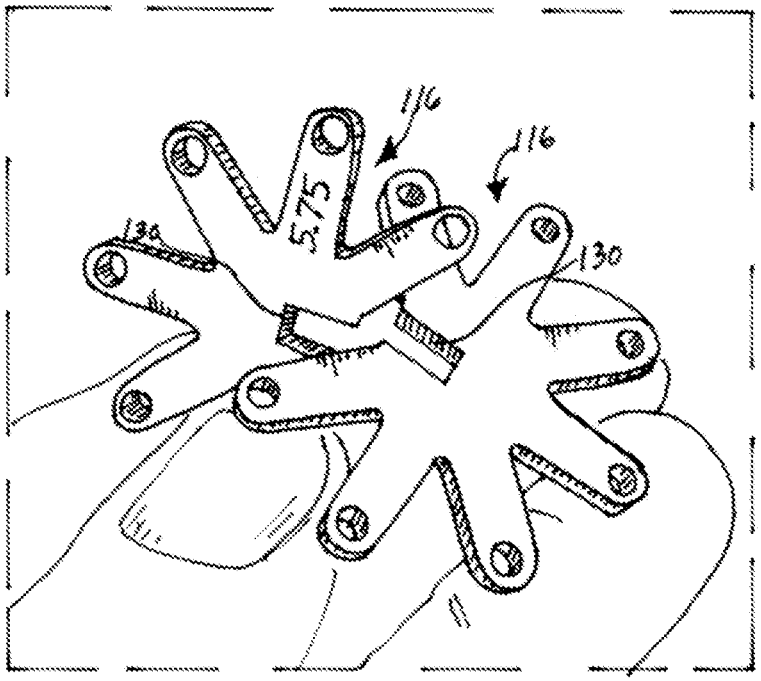
FIG. 37 depicts a pair of hubs prior to coupling.
Figure 38:
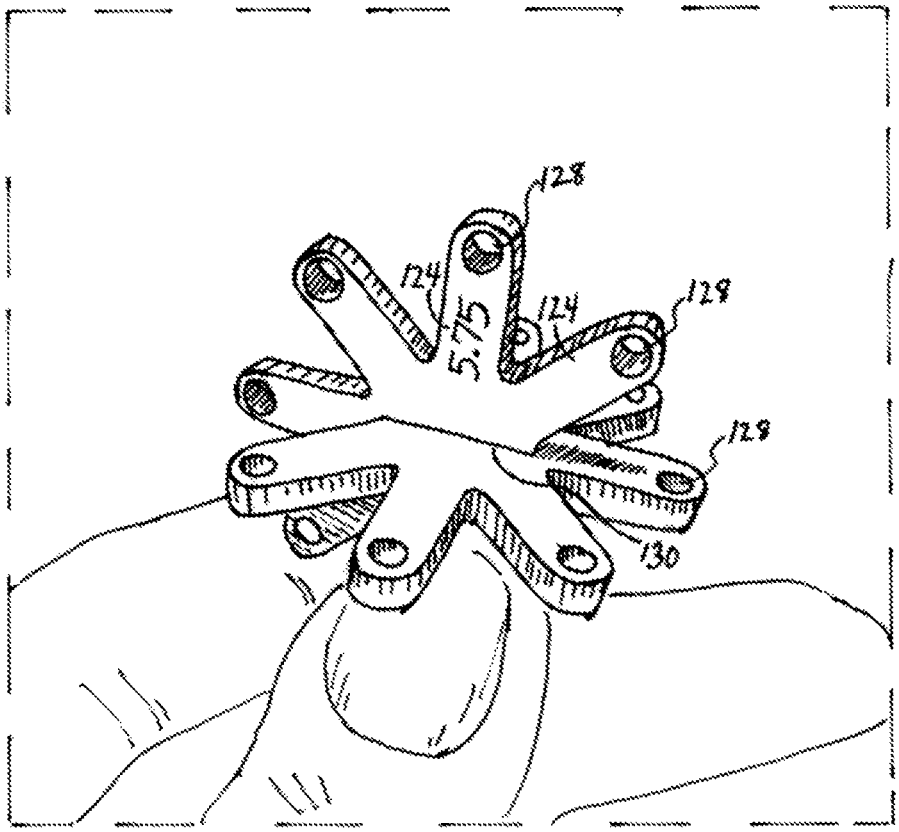
FIG. 38 depicts the pair of hubs shown in (FIG. 37) coupled.

FIGS. 37 and 38 show two identical hubs (116) adapted to interlock via slots (130).

Figure 39:
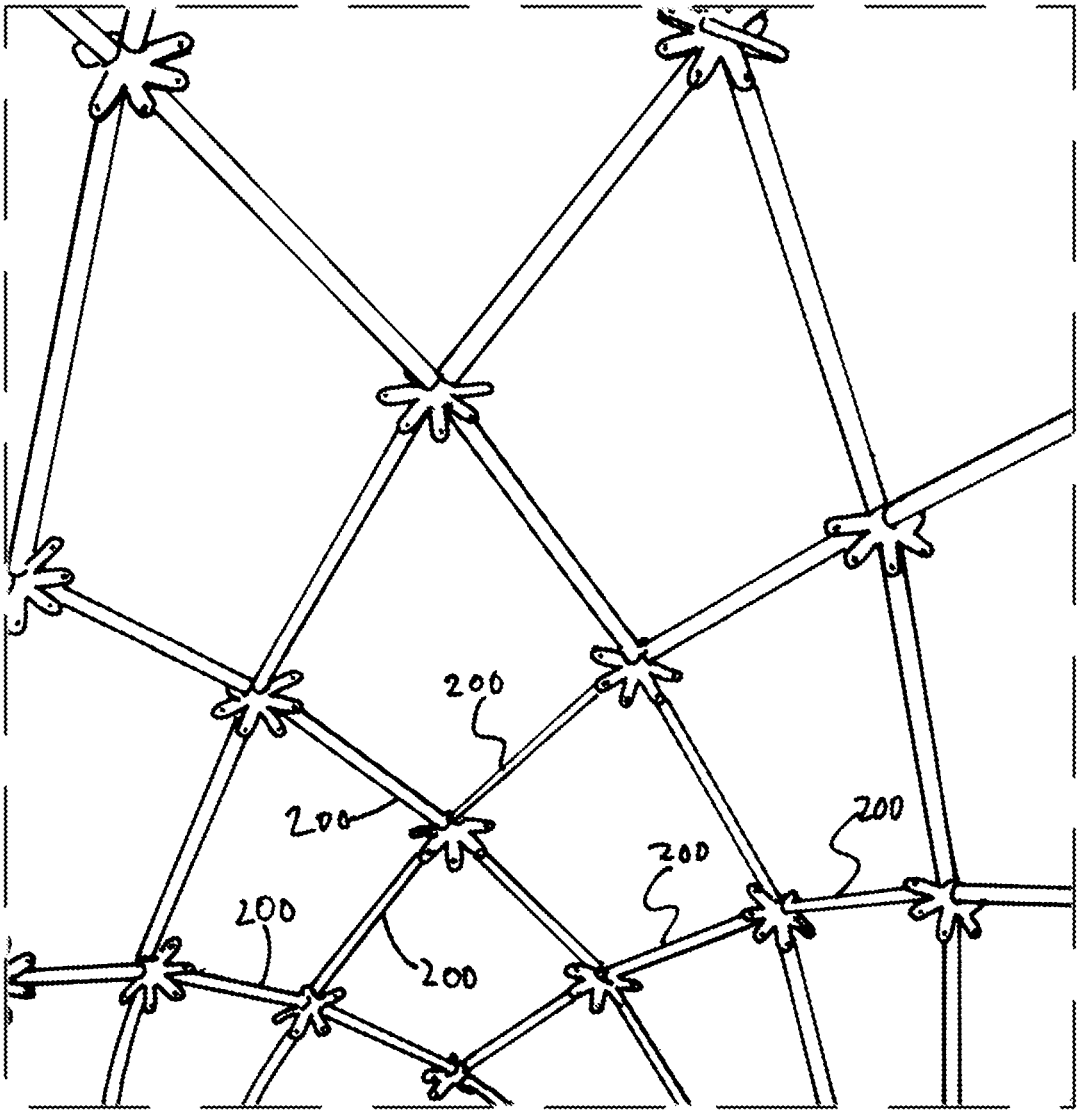
FIG. 39 shows a large construction with interconnected hubs and struts of an exemplary implementation.

FIG. 39 shows a tubular lattice construction of large diameter where the nodes of the lattice include hub pairings where hubs (118) are interlocked with hubs (112) which include block attachment prongs (134).

Figure 40:
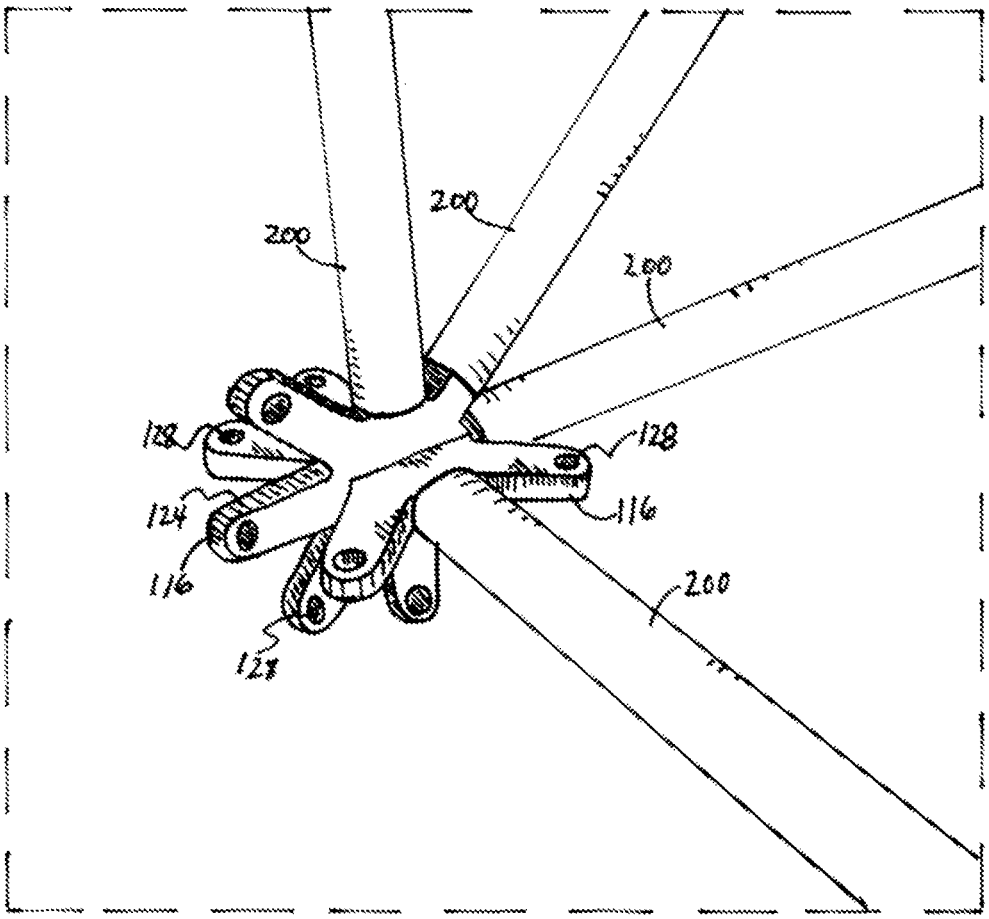
FIG. 40 is a detail view showing a pair of coupled hubs as node elements.

FIG. 40 shows a corner node that includes two interlocked hubs (116). Bottom struts (200) are set off from the floor surface by portions of the vertically disposed hub (116). FIGS. 40A and 40B illustrate the mounting of a strut to a strut coupler prong and show a cross-section taken along lines 4*a*-4*a*. Note how the mouth at the end (201) of the strut is deformed into an ellipse. In some implementations, the mouth of a strut may be reinforced (e.g., additional paper layering or a plastic coating) to improve strut longevity.

FIG. 40B is a cross-sectional view taken along lines 40*a*-40*a* (FIG. 40A) illustrating the tendency of a paper tube to deform around the strut coupler prongs such that axial rotation of the mounted strut is inhibited and provides greater rigidity when compared to other construction sets.

Figure 41A:
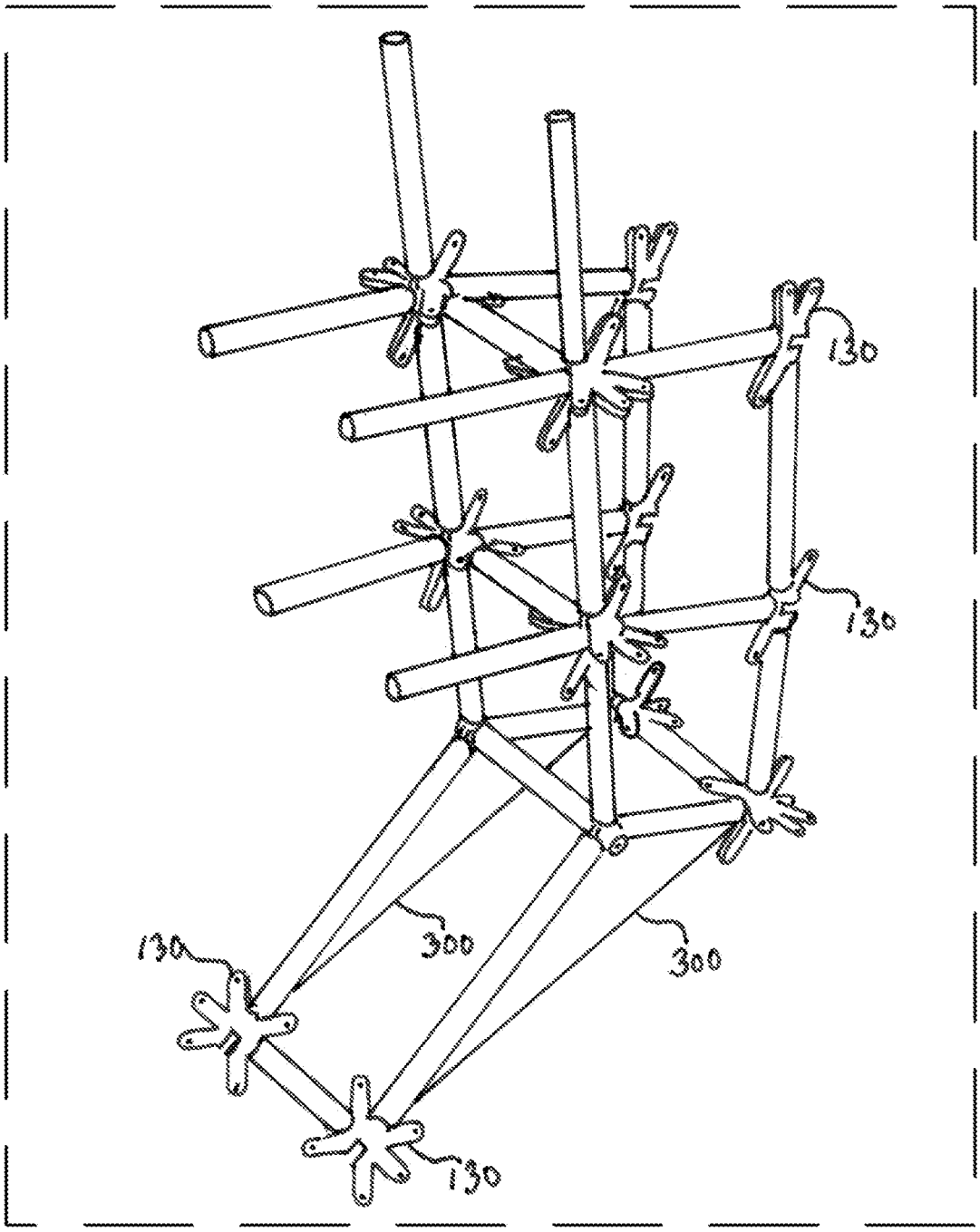
FIG. 41A is an exemplary construction using various hubs and struts showing cord secured at its ends and providing structural support for the base of the construction.
Figure 41B:
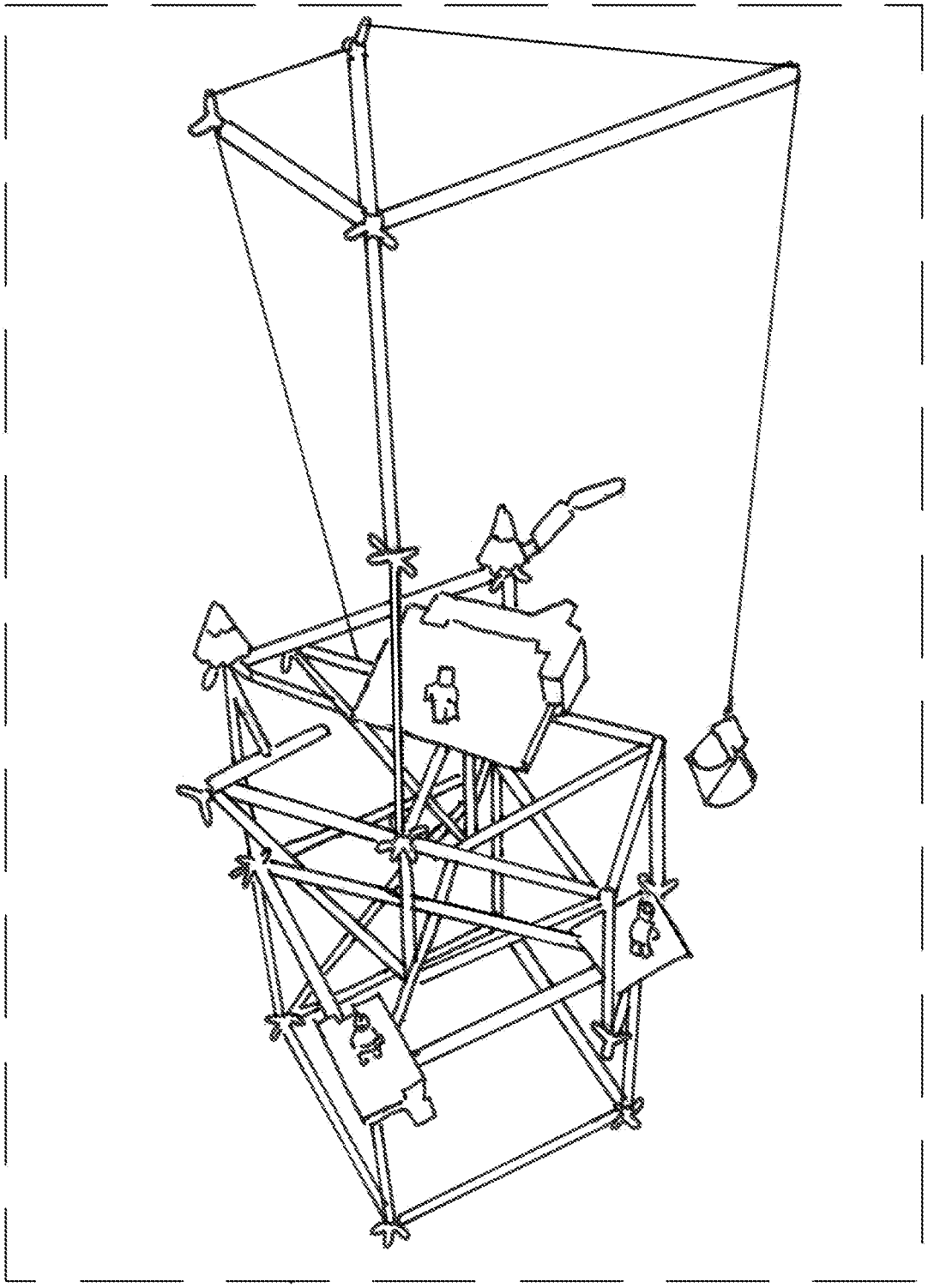
FIG. 41B shows a construction using hubs and struts where some of the hubs are joined with LEGO® style building blocks.

FIG. 41A is an exemplary construction using various hubs and struts showing cord secured at its ends and providing structural support for the base of the construction;

FIG. 41B is one example construction using the components of the invention that includes a crane construction and integration of LEGO® type building elements.

Figure 42:
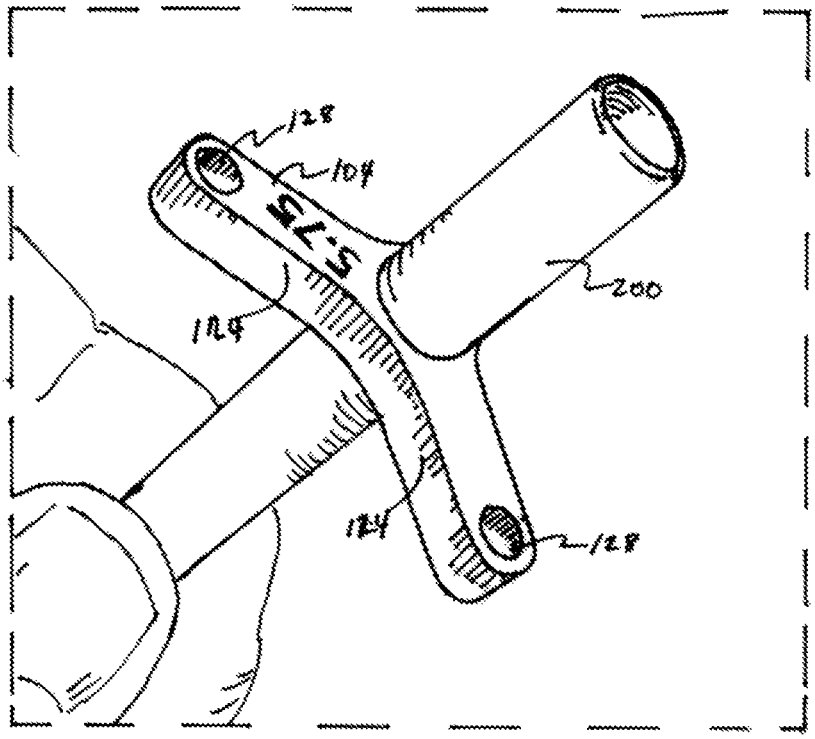
FIG. 42 shows an exemplary hub including an aperture adapted to receive a strut portion.

FIG. 42 shows hub (104) placed over a strut (200). It is possible that small elastic bands may be wrapped around portions of the hub and strut to fix the hub at any position along the strut. Likewise, it is possible for small elastic bands to be wrapped around coupled hubs to reduce the possibility of unintended separation.

Figure 43:
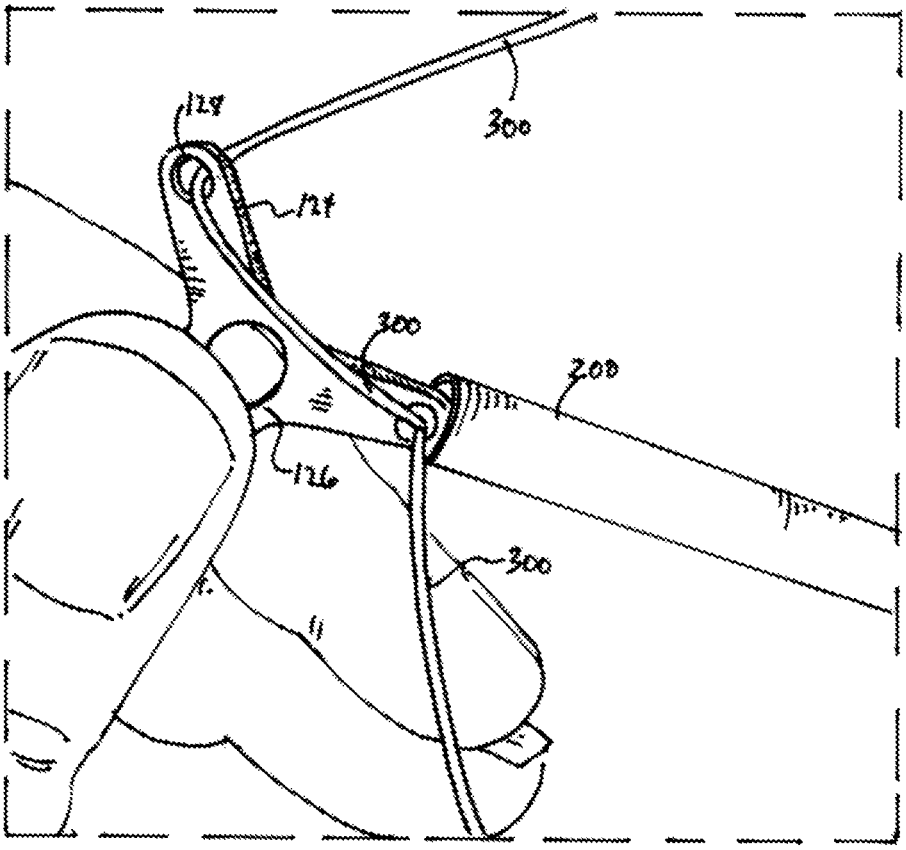
FIG. 43 shows the exemplary hub depicted in (FIG. 42) with a length of cord threaded through a distal aperture of the prong prior to insertion into an end of a strut.

FIG. 43 shows a method of securing a length of cord (300) by threading the cord through prong apertures (128) and inserting portions of the length into the space between a strut coupler prong (124) and a mouth (202) of a strut.

Figure 44:
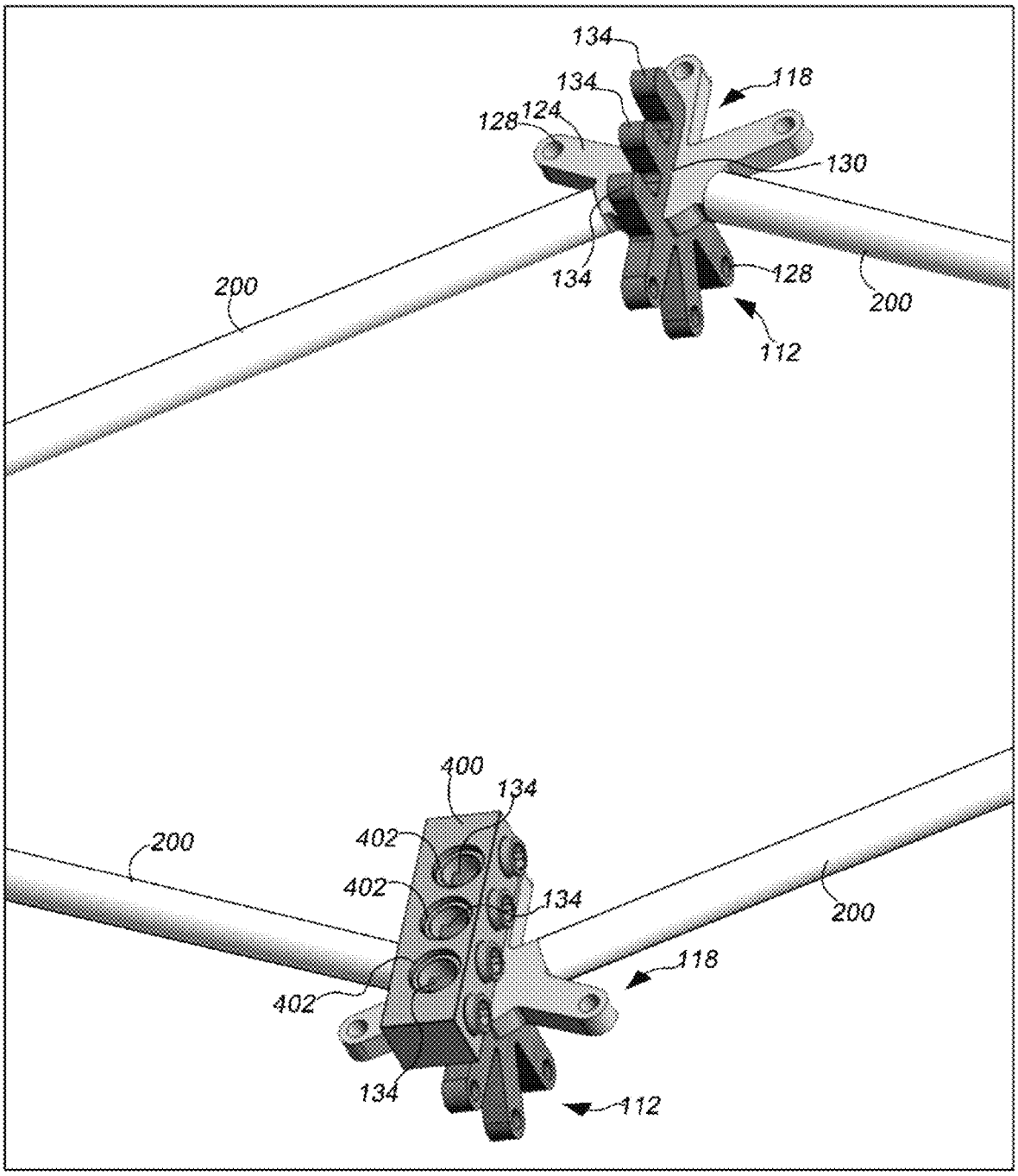
FIG. 44 shows a partial view of a diamond structure with exemplary hubs 118 and 112 coupled.

FIG. 44 is a partial view of a construction portion with two pairs of coupled hubs connected to struts. The topmost pair exposes a group of block attachment prongs and the bottom pair shows a LEGO® type block mounted to the prongs.

Figure 45:
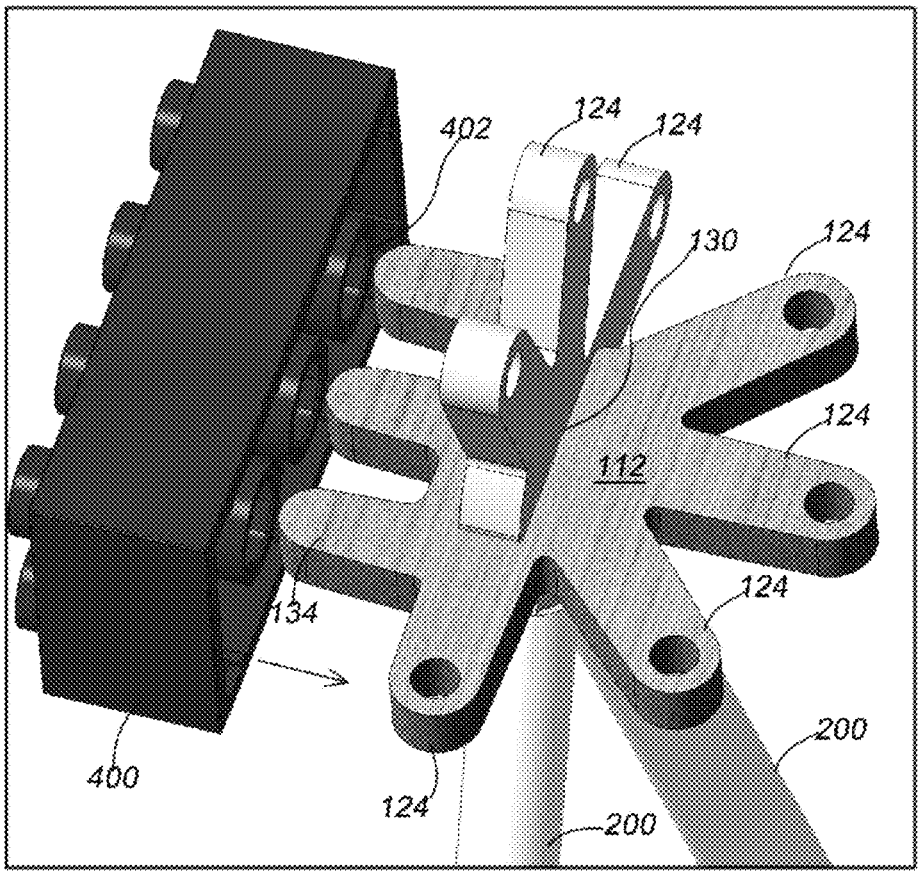
FIGS. 45 and 46 show a LEGO® type building block that is connectable to the block attachment prongs (134) of a hub (112)
Figure 46:
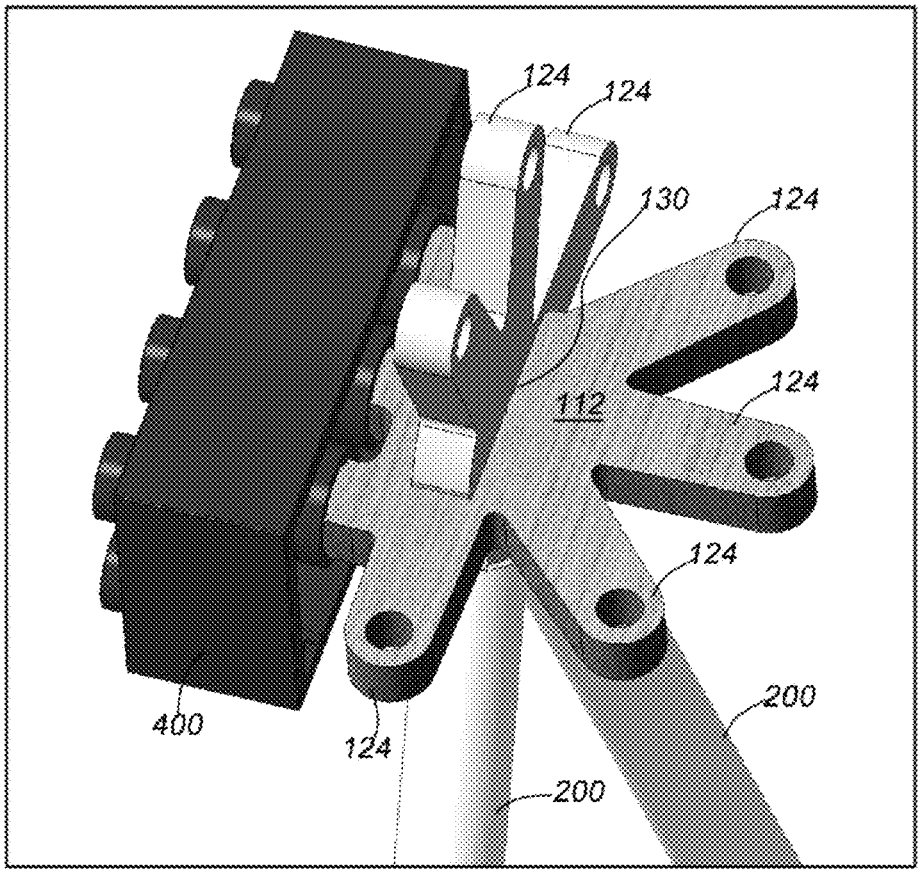

FIGS. 45 and 46 are enlarged partial views showing a pair of couple hubs before and after the mounting of the LEGO® type block thereon.

Figure 47:
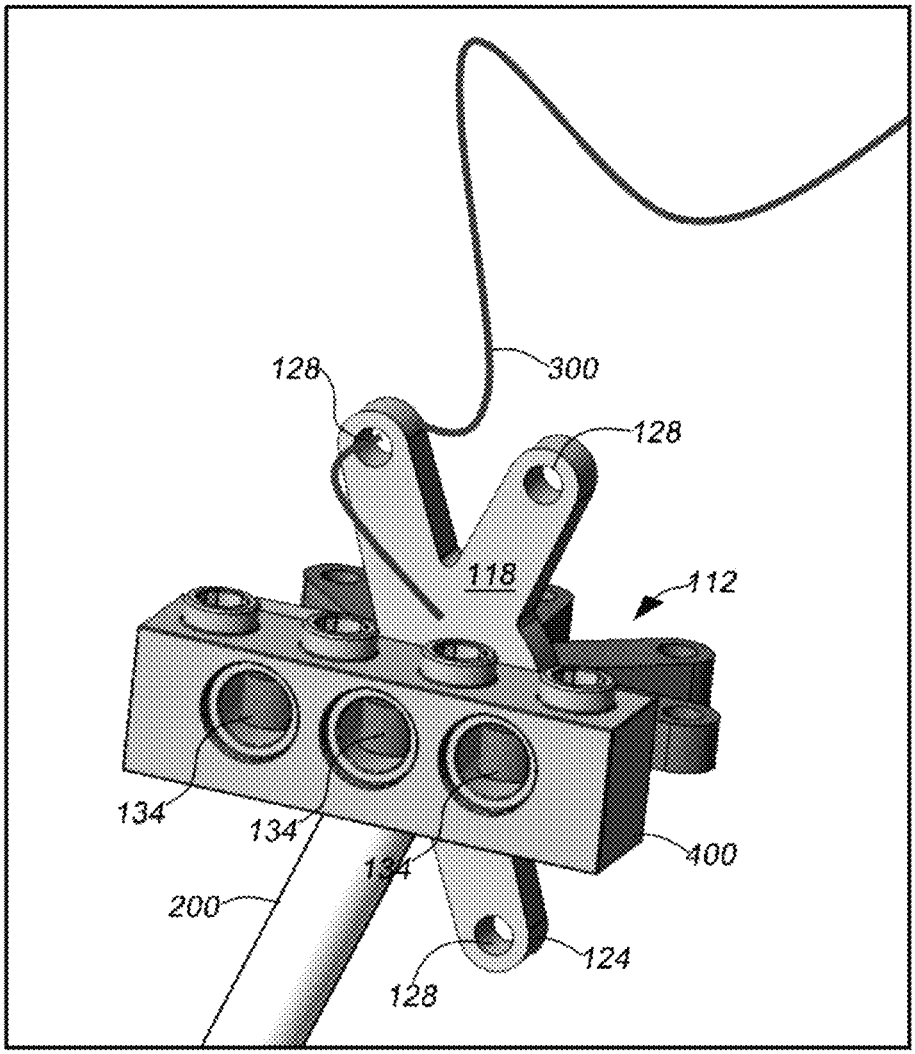
FIGS. 47 and 48 show a method of securing a length of cord to a strut coupler prong which avoids slippage of the cord.
Figure 48:
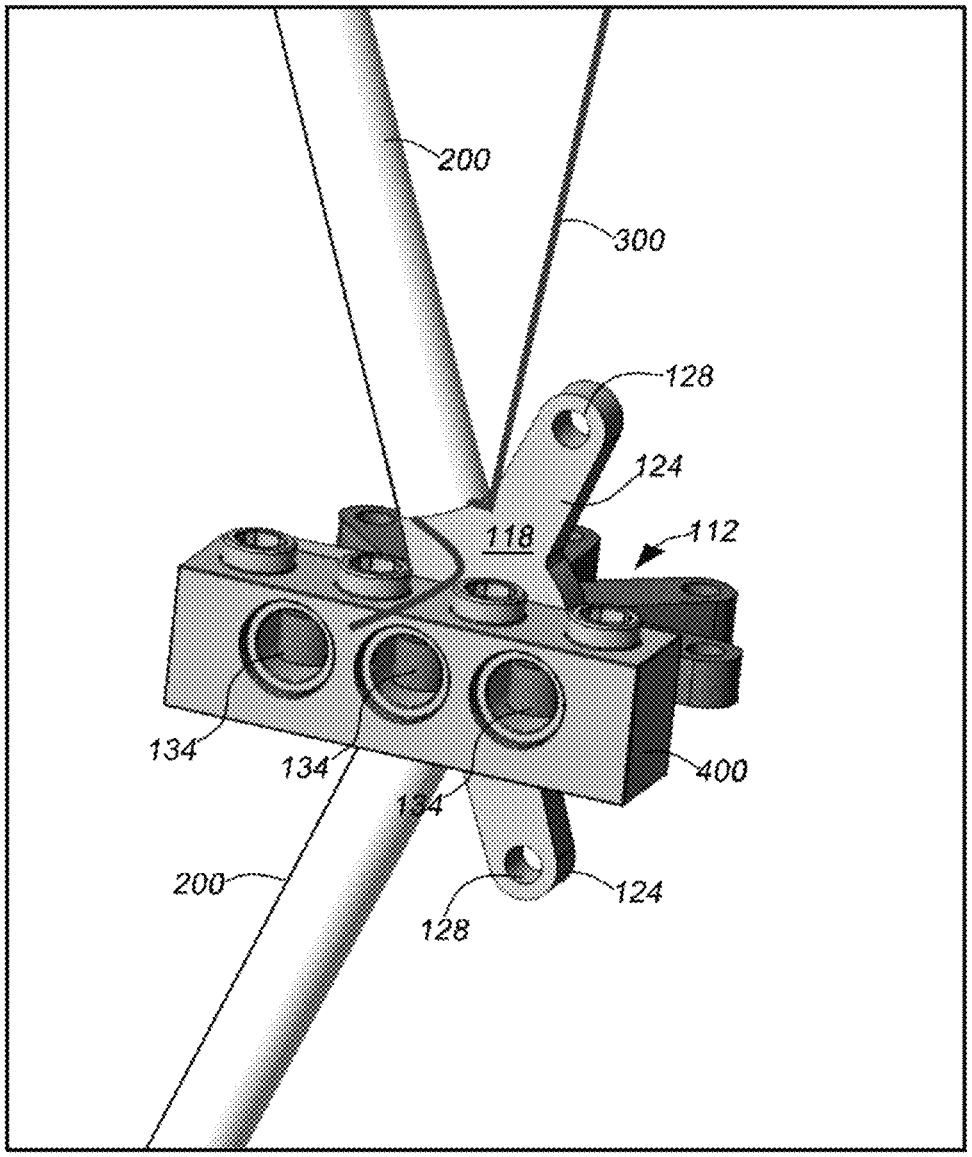

FIGS. 47 and 48 are enlarged partial views showing one example method of securing a length of cord to a hub. Persons having skill in the art and access to this disclosure will appreciate other methods of securing the length of cord using the objects and features of the present invention.

Tubular struts (200) may be paper straws or paper board tubes with walls configured to deform and mold around a strut coupler prong (124). Straw wall thickness may range from 0.30 mm to 1 mm. Alternatively, it is conceivable in some implementations that plastic straws/tubes may be used.

Figure 49:
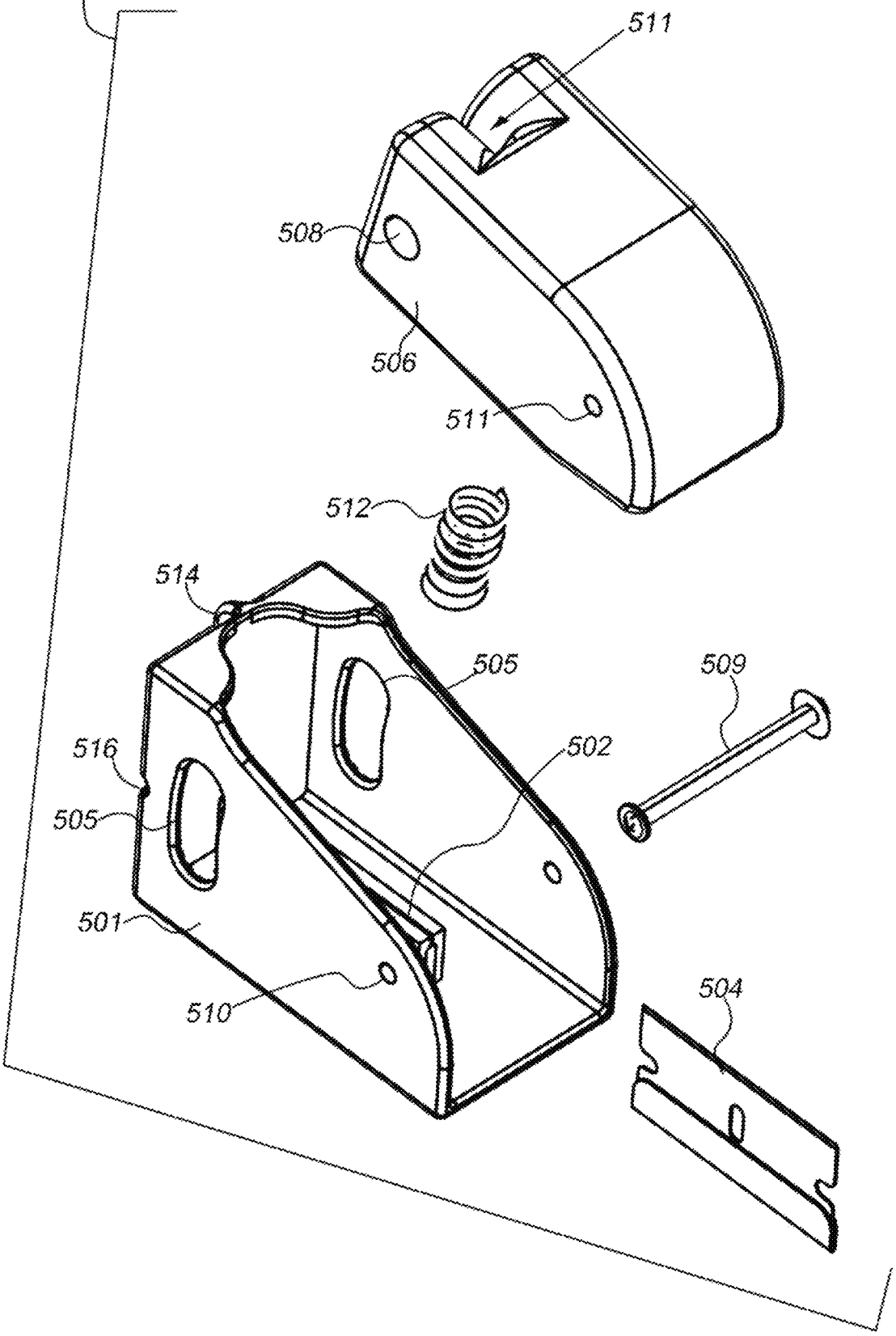
FIG. 49 is a front side exploded view of a tube cutter.
Figure 50:
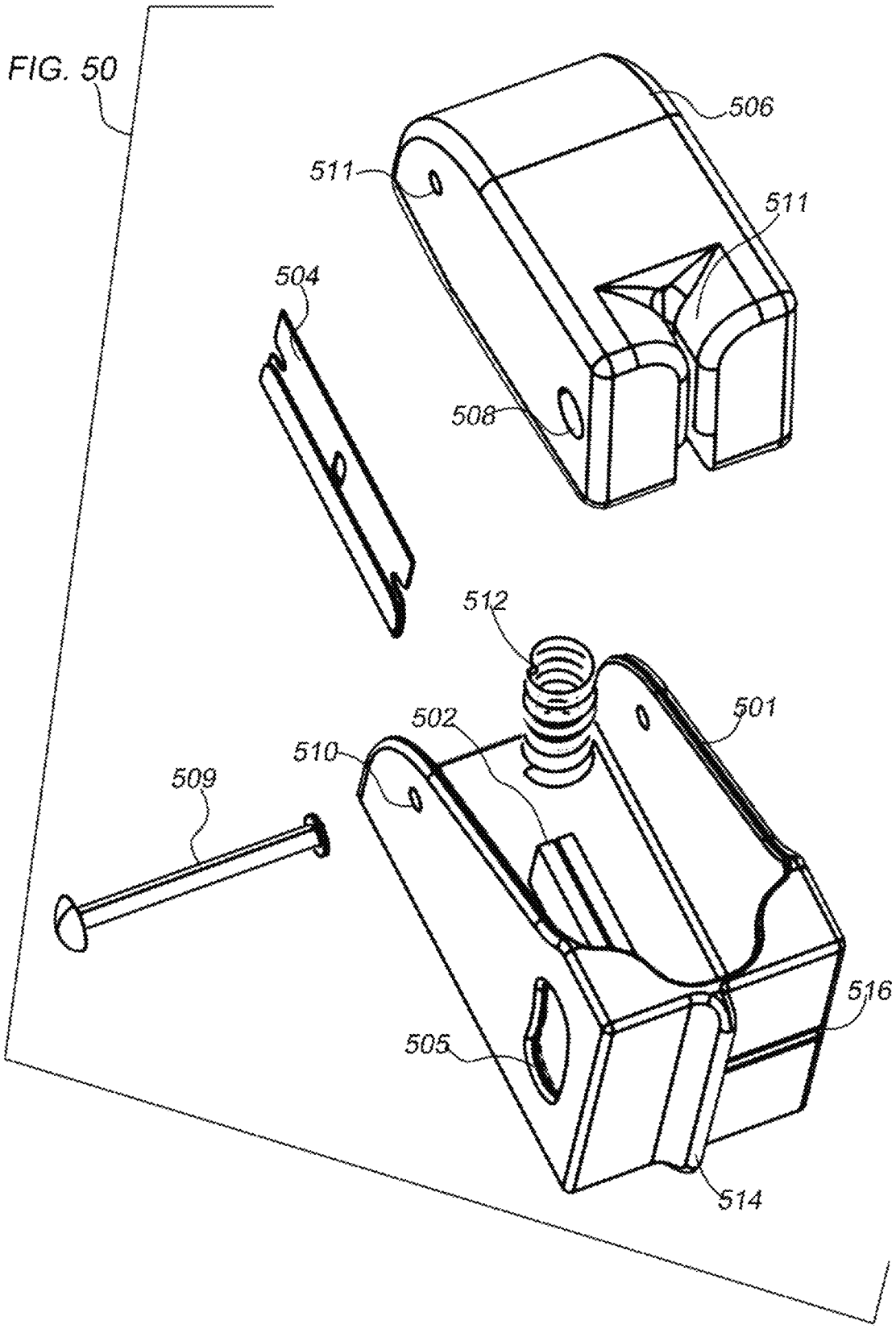
FIG. 50 is a back side exploded view thereof.
Figure 51:
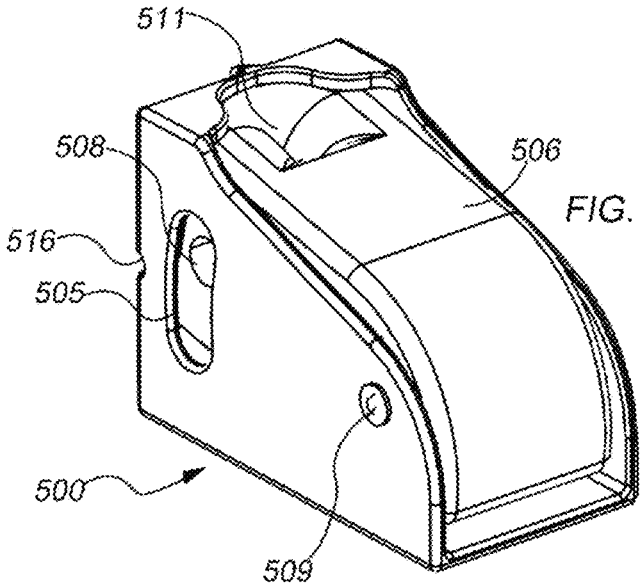
FIG. 51 is a front side perspective assembled view thereof.
Figure 52:
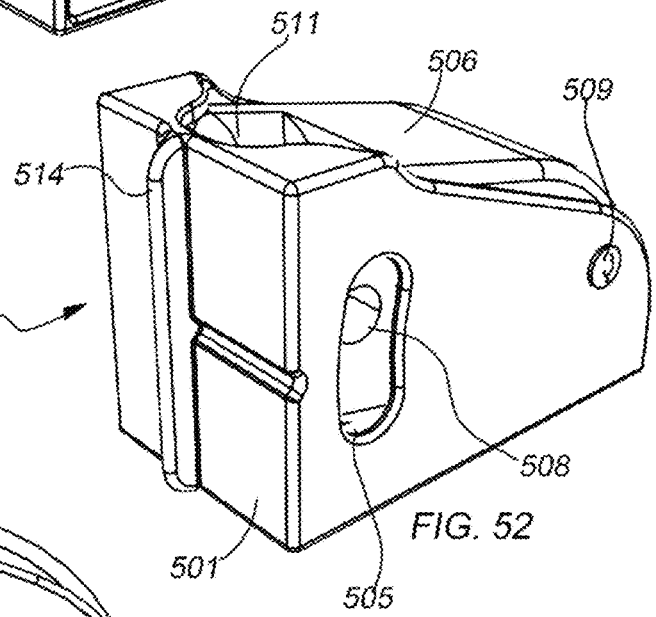
FIG. 52 is a rear side perspective assembled view thereof.
Figure 53:
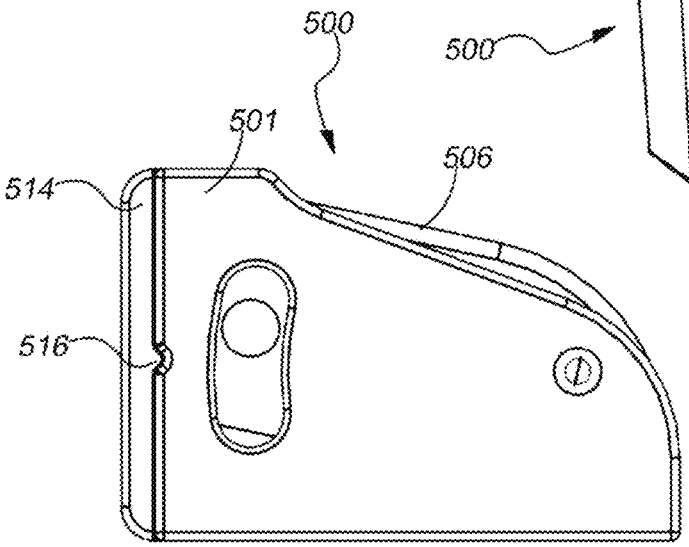
FIG. 53 is a side elevation thereof.
Figure 54:
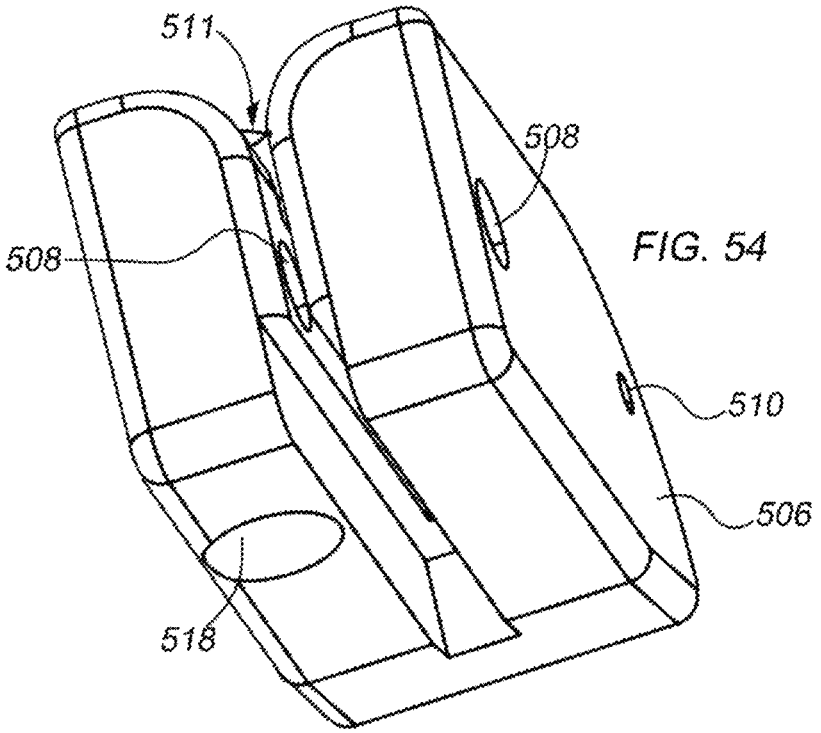
FIG. 54 is an end view of a component of the tube cutter.

FIGS. 49-55 depict an example tube/strut cutter/sizer with certain features that permit the safe cutting of tubes/straws to any desired length according to the demands of a building project. Tube/strut cutter (500) includes a base (501) with a blade cradle (502) adapted to receive a utility type blade (504) as shown, and, a, movable member (506) that is in a coupled arrangement with base (501). Other usable blade types will be appreciated by those having skill in the art. Referring to FIGS. 49 and 50, the parts are assembled as follows: typically, blade (504) is secured in cradle (502) in a pointing up position; spring (512) is placed in recess (518) (FIGS. 54, 55) which is on the underside of movable member (506) which is placed within base (501) such that an end of the movable member (506) is disposed beneath an overhang of the base which thereby entraps the movable member; base (501) and the 295 movable member are secured together using post (509) which passes through apertures (510, 511) and secures the two parts in a pivotable arrangement. Both the base (501) and the movable member (506) include aperture pairs (505, 508) that are in alignment and define aligned pairs of pass-through slots to receive a tube/straw for cutting purposes.

In order to operate the tube/strut cutter/sizer, a length of straw is placed through the 300 pass-through apertures with the tube placed atop blade at the location of the desired cutting line. Movable member (506) includes a channel (511) into which a portion of the blade (504) passes when movable member (506) is depressed causing the tube (202) to contact blade (504) and thus severing the tube. A window or opening is provided such that a visual line-of-sight of the cutter position with regard to the tube/strut is available for the user to gauge the 305 exact intended cut-line on the tube. When the tube/strut is in position the movable member (506) is depressed and forces a braced tube/strut into the blade and insures a clean cut without deformation.

Accordingly, it is intended that this disclosure encompass any further modifications, changes, rearrangements, substitutions, alternatives, design choices, and embodiments as 310 would be appreciated by those of ordinary skill in the art having benefit of this disclosure, and falling within the spirit and scope of the following claims.

What is claimed is:

1. A construction set comprising:

a plurality of struts, each strut of the plurality of struts having one or more deformable openings;

a set of hubs, each hub of the set of hubs including one or more strut coupler prongs, each of the one or more strut coupler prongs include a proximal end and a distal end, a thickness, a front face, a back face and sides, and between each proximal end of each of the one or more strut coupler prongs is a hub border and the proximal end of each of the one or more tapered strut coupler prongs is adapted to expandably deform an opening of a connected strut forming a friction fit wherein corners of the one or more strut coupler prongs are adapted to press into internal surfaces of a connected strut;

a first subset of the set of hubs include a centrally disposed aperture surrounded by the one or more strut coupler prongs;

a second subset of the set of hubs include a rectangular centrally disposed slot that includes a first closed end and a second end that is open at the hub border and the rectangular centrally disposed slot is configured to receive portions of a hub from the set of hubs;

the strut coupler prongs are tapered in a direction away from the rectangular centrally disposed slot and the centrally disposed aperture, and the front face and back face of the strut coupler prongs are substantially planar, and at least some of the strut coupler prongs include an aperture at the distal end.

2. The construction set according to claim 1 further comprising at least two hubs including block attachment prongs.

* * * * *